US009435141B2

(12) United States Patent
Tien

(10) Patent No.: US 9,435,141 B2
(45) Date of Patent: Sep. 6, 2016

(54) PANIC EXIT DOOR LOCK WITH AN INDICATION OF A LOCKING STATE

(71) Applicant: I-TEK METAL MFG. CO., LTD., Tainan (TW)

(72) Inventor: Hung-Jen Tien, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 394 days.

(21) Appl. No.: 14/132,114

(22) Filed: Dec. 18, 2013

(65) Prior Publication Data

US 2015/0167354 A1 Jun. 18, 2015

(51) Int. Cl.

| | |
|---|---|
| ***E05B 41/00*** | (2006.01) |
| ***E05B 65/10*** | (2006.01) |
| ***E05B 9/08*** | (2006.01) |

(52) U.S. Cl.

CPC ..... *E05B 41/00* (2013.01); *E05B 9/08* (2013.01); *E05B 65/1046* (2013.01); *Y10T 292/0908* (2015.04)

(58) Field of Classification Search

CPC ..... E05B 39/00; E05B 63/16; E05B 65/102; E05B 65/1086; E05B 63/18; E05B 63/185; E05B 63/22; E05B 65/1006; E05B 65/1053; E05B 41/00; E05B 65/10; E05B 65/1046; E05B 65/1093; Y10T 70/5159; Y10T 70/8946; E05C 9/046; E05C 9/048; Y10S 70/60

USPC ..... 70/92, 107–111, 210, 211, 439, 441; 292/21, 92, 336.3

See application file for complete search history.

(56) References Cited

U.S. PATENT DOCUMENTS

| | | | | | |
|---|---|---|---|---|---|
| 3,334,500 | A * | 8/1967 | Bejarano | E05B 63/20 | 292/21 |
| 4,156,541 | A * | 5/1979 | Babb, Jr. | E05C 9/025 | 292/21 |
| 4,979,767 | A * | 12/1990 | Lin | E05B 59/00 | 292/336.3 |
| 4,982,986 | A * | 1/1991 | Gressett, Jr. | E05B 3/065 | 292/165 |
| 5,492,380 | A * | 2/1996 | Smallegan | E05B 53/00 | 292/140 |
| 5,658,026 | A * | 8/1997 | Nigro, Jr. | E05B 13/002 | 292/336.3 |
| 5,664,816 | A * | 9/1997 | Nigro, Jr. | E05B 17/0062 | 292/165 |
| 5,947,534 | A * | 9/1999 | Zarzycki, Jr. | E05B 65/1053 | 292/170 |
| 7,634,927 | B1 * | 12/2009 | Tien | E05B 3/065 | 292/21 |

(Continued)

*Primary Examiner* — Suzanne Barrett

(74) *Attorney, Agent, or Firm* — Alan D. Kamrath; Kamrath IP Lawfirm, P.A.

(57) ABSTRACT

A panic exit door lock includes an inner cylinder seat. A shield is formed on the inner cylinder seat and includes a window. A driving block is pivotably connected to an actuating block operably connected to an outer lock core. The driving block includes a sleeve portion mounted around the actuating block. A flange is formed on the sleeve portion and is operably connected to a limiting member. An indicator member is pivotably connected to the inner cylinder seat and includes an indicator having a first portion indicating the limiting member is in a release position in which rotation of a handle retracts a latch and a second portion indicating the limiting member is in a blocking position in which the handle can not be rotated to retract the latch. One of the first and second portions is aligned with the window to indicate the position of the limiting member.

3 Claims, 18 Drawing Sheets

(56) References Cited

U.S. PATENT DOCUMENTS 8,011,702 B2 * 9/2011 Tien ..... E05B 65/1006 292/21
8,267,442 B2 * 9/2012 Tien ..... E05B 3/00 292/138
9,140,032 B2 * 9/2015 Lin ..... E05B 17/0066
9,273,495 B2 * 3/2016 Tien ..... E05B 65/1053
2012/0175892 A1 * 7/2012 Shen ..... E05B 47/0673 292/92
2012/0256428 A1 * 10/2012 Tien ..... E05B 65/104 292/92
2015/0167354 A1 * 6/2015 Tien ..... E05B 41/00 292/92
2015/0252592 A1 * 9/2015 Tien ..... E05B 65/1053 70/92

* cited by examiner

PANIC EXIT DOOR LOCK WITH AN INDICATION OF A LOCKING STATE

BACKGROUND OF THE INVENTION

The present invention relates to a panic exit door lock and, more particularly, to a panic exit door lock including a locking state indicator providing a visual indication from an inner side of a door.

Panic exit door locks (also referred to as "exit devices for doors") are widely used on panic exit doors and passageway doors in apartment houses and buildings to keep the frequently used doors in a state allowing easy passage. Such panic exit door locks generally include a press bar mounted to a side of the door and having a larger area to allow easy and rapid unlatching through simple pressing of the press bar, which is particularly useful in case of emergency, such as fire. Furthermore, the panic exit door locks can include a locking function in which a user at the inner side of the door can easily unlock while a user at the outer side of the door must use a key to unlock. However, the user at the inner side of the door can not confirm whether the panic exit door lock is in the locking state by pressing the press bar.

Thus, a need exists for a panic exit door lock including a locking state indicator providing a visual indication from the inner side of the door.

BRIEF SUMMARY OF THE INVENTION

The present invention solves this need and other problems in the field of locking state indication of panic exit door locks by providing a panic exit door lock including a base adapted to be mounted to an inner side of a door. A sliding device is slideably mounted to the base. A latch is operably coupled to the sliding device and is moveable between an extended, latching position and a retracted, unlatching position. A cover is adapted to be mounted to an outer side of the door. A sliding member is slideably received in the cover and is operably connected to the sliding device. A handle is pivotably mounted to the cover and is operably connected to the sliding member such that pivotal movement of the handle causes sliding of the sliding member, moving the latch between the extended, latching position and the retracted, unlatching position. A limiting member is pivotably received in the cover between a blocking position not allowing movement of the sliding member and a release position allowing movement of the sliding member. The handle is rotatable when the limiting member is in the release position. The handle is not rotatable when the limiting member is in the blocking position. An outer cylinder includes an outer cylinder body mounted to the cover and an outer lock core rotatably received in the outer cylinder body. An actuating block is fixed to the outer lock core. The actuating block and the outer lock core are jointly rotatable. A driving member is fixed to the sliding member. The driving member and the sliding member are jointly moveable. The driving member includes a rod coupled to the sliding device.

The panic exit door lock further includes a mover rotatably mounted around the cylinder and including a tab and an actuating bar. The tab is operably connected to the actuating block. The actuating bar is operably connected to the limiting member. The mover is rotated to move the limiting member between the blocking position and the release position when the actuating block is rotated by rotating the outer lock core. An inner cylinder seat is fixed to the base. The inner cylinder seat includes a peripheral wall defining a first compartment. A shield is formed on the peripheral wall and defines a second compartment. The shield further includes a window in communication with the second compartment. An inner cylinder is received in the first compartment and includes an inner cylinder body and an inner lock core rotatably received in the inner cylinder body. A driving block is pivotably connected to the actuating block and includes a connection portion and a sleeve portion. The sleeve portion is mounted around the actuating block. The driving block further includes a coupling hole in an end of the connection portion. A flange is formed on an outer periphery of the sleeve portion and is operably connected to the tab of the mover.

The panic exit door lock further includes an indicator member having a first section pivotably connected to the inner cylinder seat. The indicator member further includes a second section fixed to the connection portion of the driving block. The indicator member and the driving block are jointly moveable. An arm extends from the indicator member. An indicator is provided on the arm and has a first portion indicating the limiting member is in the release position and a second portion indicating the limiting member is in the blocking position. One of the first and second portions is selectively aligned with the window. A tongue includes front and rear ends spaced from each other along a first axis. The rear end of the tongue is fixed to the inner lock core. The front end of the tongue is coupled in the coupling hole of the driving block. The inner lock core, the tongue, and the driving block are jointly rotatable.

When the inner lock core is rotated, the driving block and the mover are rotated to move the limiting member between the blocking position and the release position. When the outer lock core is rotated, the actuating block is rotated to push the mover to move the limiting member between the blocking position and the release position, and the mover actuates the driving block and the indicator member to pivot jointly. When the limiting member is in the release position, the first portion is aligned with the window of the inner cylinder seat. On the other hand, when the limiting member is in the blocking position, the second portion is aligned with the window of the inner cylinder seat.

In a form shown, the inner lock cylinder further includes a first end face and a second end face spaced from the first end face. The first compartment extends from the first end face through the second end face. The inner cylinder seat further includes a pivotal portion extending from the second end face. The pivotal portion includes a pivotal hole extending from the third end face to the first compartment along the first axis. The pivotal portion further includes a notch. The first section of the indicator member is pivotably received in the pivotal hole of the inner cylinder seat. The arm extends through the notch into the second compartment. Two inner protrusions are formed on an inner periphery of the coupling hole and are spaced from each other in a diametric direction. Pivotal movement of the tongue presses against the inner protrusions to pivot the driving block and the indicator member.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
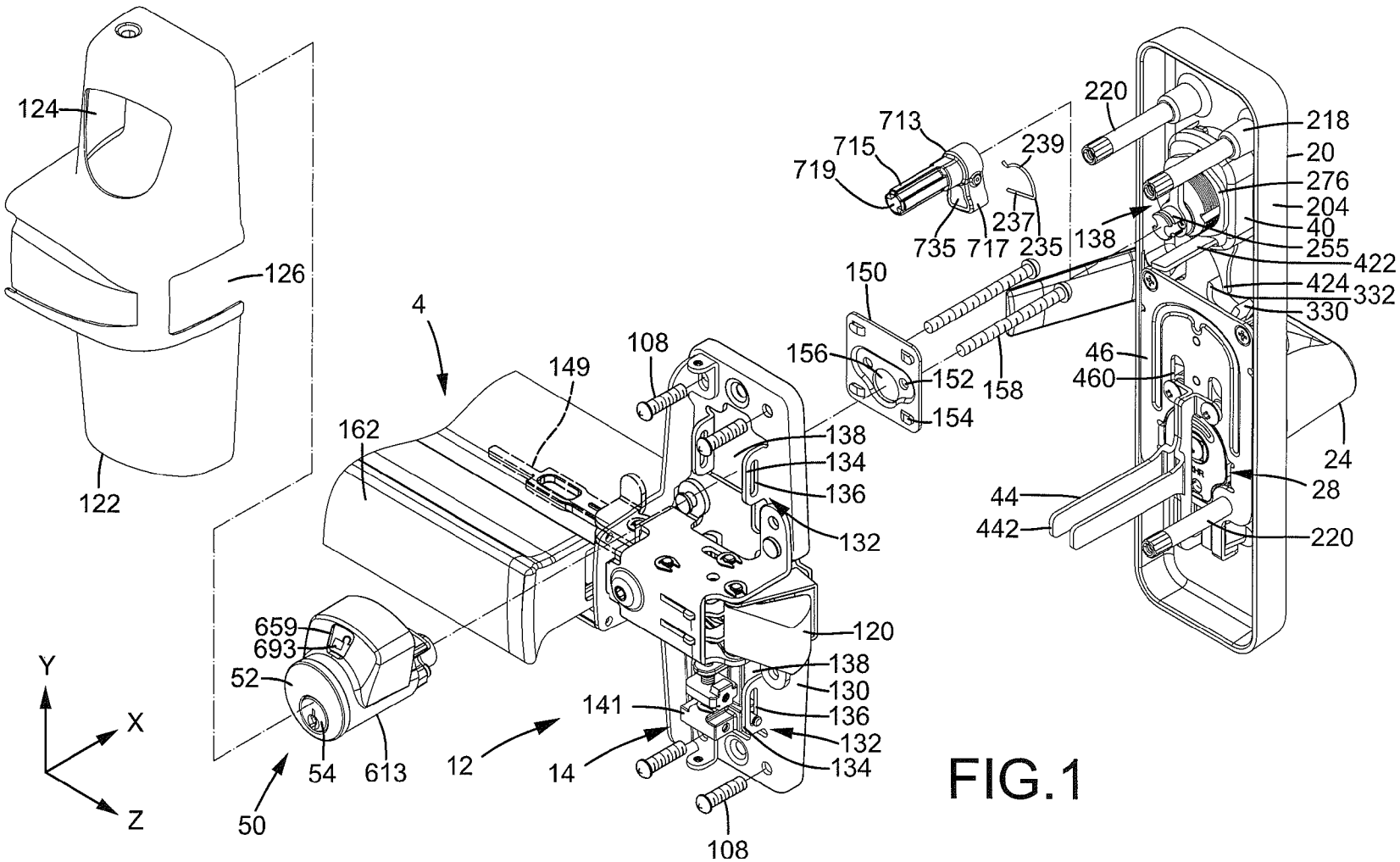
FIG. 1 shows an exploded, perspective view of a panic exit door lock according to the present invention.
Figure 2:
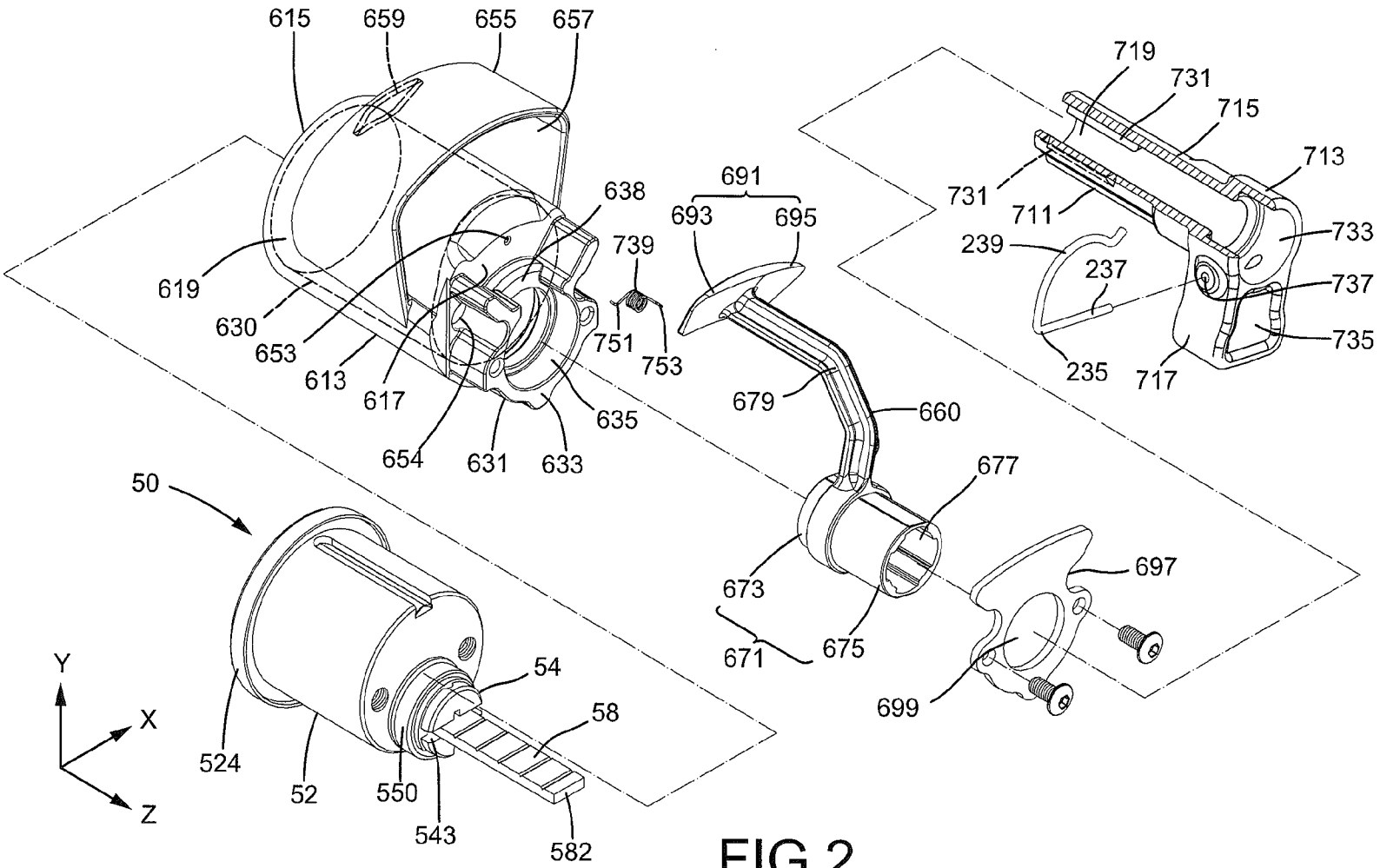
FIG. 2 is an exploded, perspective view of a portion of a locking mechanism of the panic exit door lock of FIG. 1.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "lower", "upper", "inner", "outer", "side", "end", "portion", "section", "axial", "radial", "lateral", "horizontal", "vertical", "annular", "inward", "spacing", "clockwise", "counterclockwise", "length", "height", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A panic exit door lock according to the present invention is shown in the drawings and adapted to be mounted to a door 10 in the form shown as a panic exit door. According to the form shown, the panic exit door lock includes a latch device 12 mounted to an inner side 10A of door 10, an inner operational device 4 operably connected to latch device 12, an outer operational device 2 mounted to an outer side 10B of door 10 spaced from inner side 10A along a first axis X, and a locking mechanism 3 mounted between latch device 12 and outer operational device 2. Door 10 includes a mounting hole 106 for receiving components of latch device 12, locking mechanism 3, and outer operational device 2. Outer operational device 2 allows a user to open door 10 from outer side 10B. Inner operational device 4 allows the user to open door 10 from inner side 10A. Locking mechanism 3 allows the user to set the panic exit door lock in a locking state or unlocking state from inner side 10A or outer side 10B. When the panic exit door lock is in the locking state, door 10 can not be opened through operation of outer operational device 2 but can be opened by operating inner operational device 4. On the other hand, when the panic exit door lock is in the unlocking state, operation of either outer operational device 2 or inner operational device 4 can open door 10.

According to the form shown, latch device 12 includes a base 130 fixed to inner side 10A of door 10. Base 130 includes upper and lower slots 138 in upper and lower portions thereof. Base 130 further includes an upper guiding mechanism 132 formed on a side thereof. Upper guiding mechanism 132 includes parallel, spaced tabs 134 formed on two sides of upper slot 138 and having aligned vertical tracks 136 extending along a second axis Y perpendicular to first axis X. The side of base 130 further includes a lower guiding mechanism 132 located below upper guiding mechanism 132 along second axis Y. Lower guiding mechanism 132 includes parallel, spaced tabs 134 formed on two sides of lower slot 138 and having aligned vertical tracks 136 extending along second axis Y. A sliding device 14 includes a slide 141 slideably received in vertical tracks 136 of lower guiding mechanism 132. A linking rod 149 is slideably mounted between upper and lower guiding mechanisms 132 and operably coupled to a latch 120, so that movement of linking rod 149 along a third axis Z perpendicular to first and second axes X and Y causes movement of latch 120 between an extended, latching position and a retracted, unlatching position. In the form shown, a link 133 is mounted between linking rod 149 and slide 141. Specifically, link 133 is pivotably connected to linking rod 149 and to slide 141. Furthermore, link 133 is pivotably connected to base 130. When linking rod 149 moves along third axis Z, link 133 pivots to move slide 141 along second axis Y.

According to the form shown, base 130 is housed in a casing 122 that includes a receiving hole 124 aligned with upper guiding mechanism 132. Casing 122 further includes a notch 126 in a side thereof through which latch 120 extends. Inner operational device 4 includes an operative member 162 in the form shown as a press bar moveable along first axis X and operably connected to linking rod 149. Operative member 162 can be operated to move linking rod 149 along third axis Z to retract latch 120.

According to the form shown, outer operational device 2 includes a cover 20 having a sidewall 202 extending along second axis Y and an annular wall 204 extending perpendicularly along a periphery of sidewall 202, defining a space 200 between annular wall 204 and sidewall 202. Sidewall 202 includes a receiving portion 205 in an upper portion thereof. Receiving portion 205 extends into space 200 and forms a compartment 206. Furthermore, receiving portion 205 includes two parallel, spaced, chamfered faces 209 on an outer periphery thereof. Compartment 206 includes an opening 208 in communication with space 200. Sidewall 202 further includes upper and lower fixing holes 210 below opening 208 along second axis Y. Sidewall 202 further includes an engaging hole 214 below lower fixing hole 210 along second axis Y. A protrusion 215 extends from an inner face of sidewall 202 along first axis X and is located below engaging hole 214. Protrusion 215 includes a first groove 216 and a second groove 219 above first groove 216 along second axis Y and shallower than first groove 216 along first axis X. Two pegs 218 are formed on the inner face of sidewall 202 and are located above opening 208 along second axis Y. Annular wall 204 includes two supports 217 on two inner, vertical faces thereof. Each support 217 has a height from sidewall 202 the same as that of protrusion 215. Sidewall 202 further includes a positioning hole 212 adjacent to upper fixing hole 210.

Two mounting posts 220 are engaged with screw holes in pegs 218. Furthermore, two additional mounting posts 220 are engaged with screw holes in protrusions 215. Cover 20 is mounted to outer side 10B of door 10 and covers mounting hole 106, with annular wall 204 abutting outer side 10B and with each mounting post 220 extending through mounting hole 106 to a position adjacent to base 130. A fastener 108 in the form shown as a screw extends through base 130 into a screw hole in an end of each mounting post 220, so that base 130 is fixed to inner side 10A of door 10 and so that cover 20 is fixed to outer side 10B of door 10.

According to the form shown, outer operational device 2 further includes a sleeve 22 mounted to an outer face of sidewall 202 and in the form shown as a truncated cone. Sleeve 22 includes a central pivot hole 222 aligned with engaging hole 214 of cover 20. Fasteners 224 extend through sidewall 202 into holes 226 in an end face of sleeve 22 to fix sleeve 22 on cover 20.

According to the form shown, outer operational device 2 further includes a handle 24 having a stem 240 adapted to be gripped by a user and a shank 242 extending from an end of stem 240. Shank 242 includes an engaging portion 244 in the form shown having two chamfered faces 246 so that engaging portion 244 has non-circular cross sections. Shank 242 is pivotably received in pivot hole 222 of sleeve 22 about a pivot axis. Engaging portion 244 is located outside of pivot hole 222. A retainer ring 248 in the form shown as a C-clip is mounted in an annular groove of shank 242 to prevent axial movement of handle 24 along the pivot axis.

Figure 7:
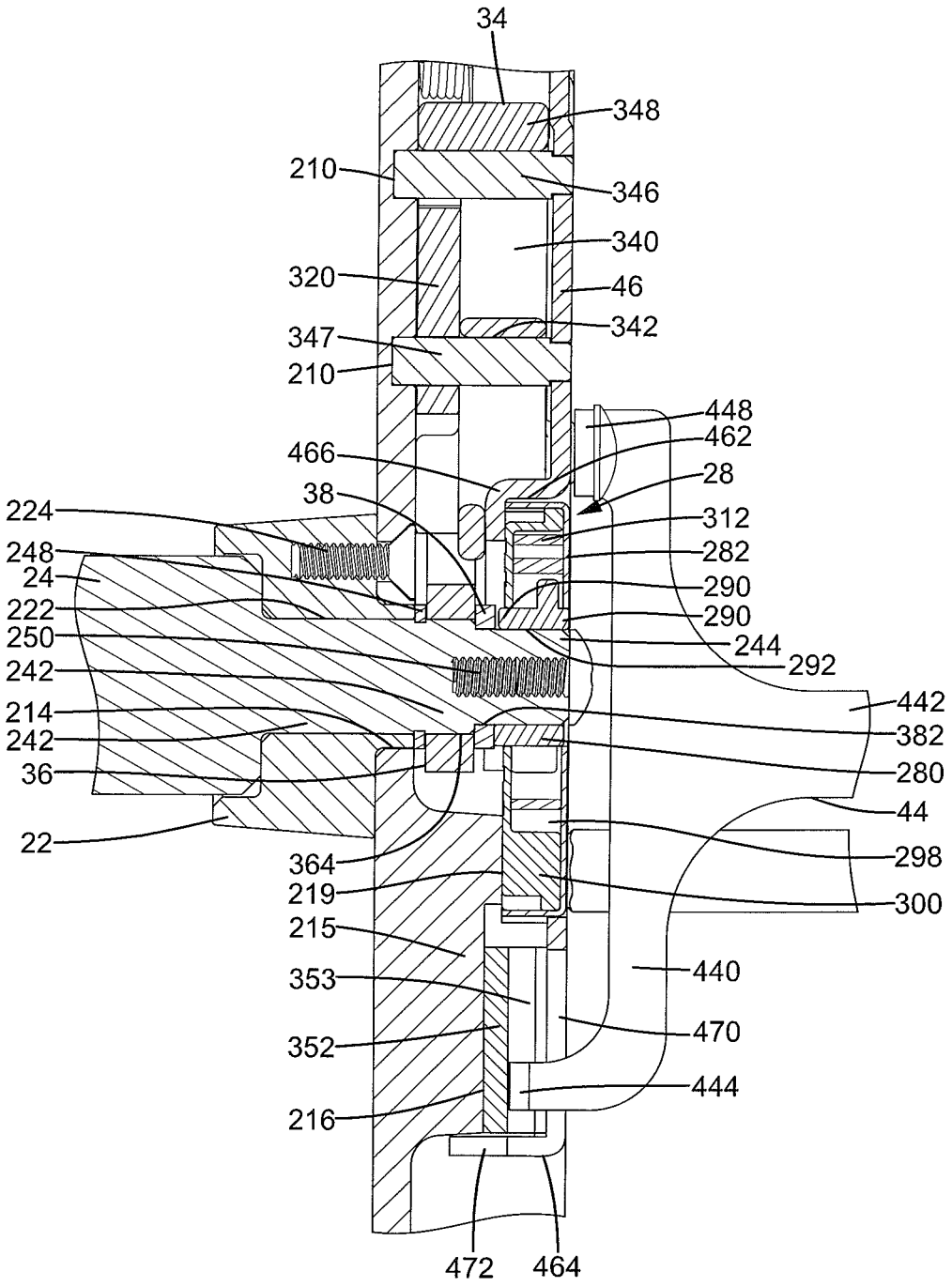
FIG. 7 is a cross sectional view taken along section line 7-7 of FIG. 6.
Figure 8:
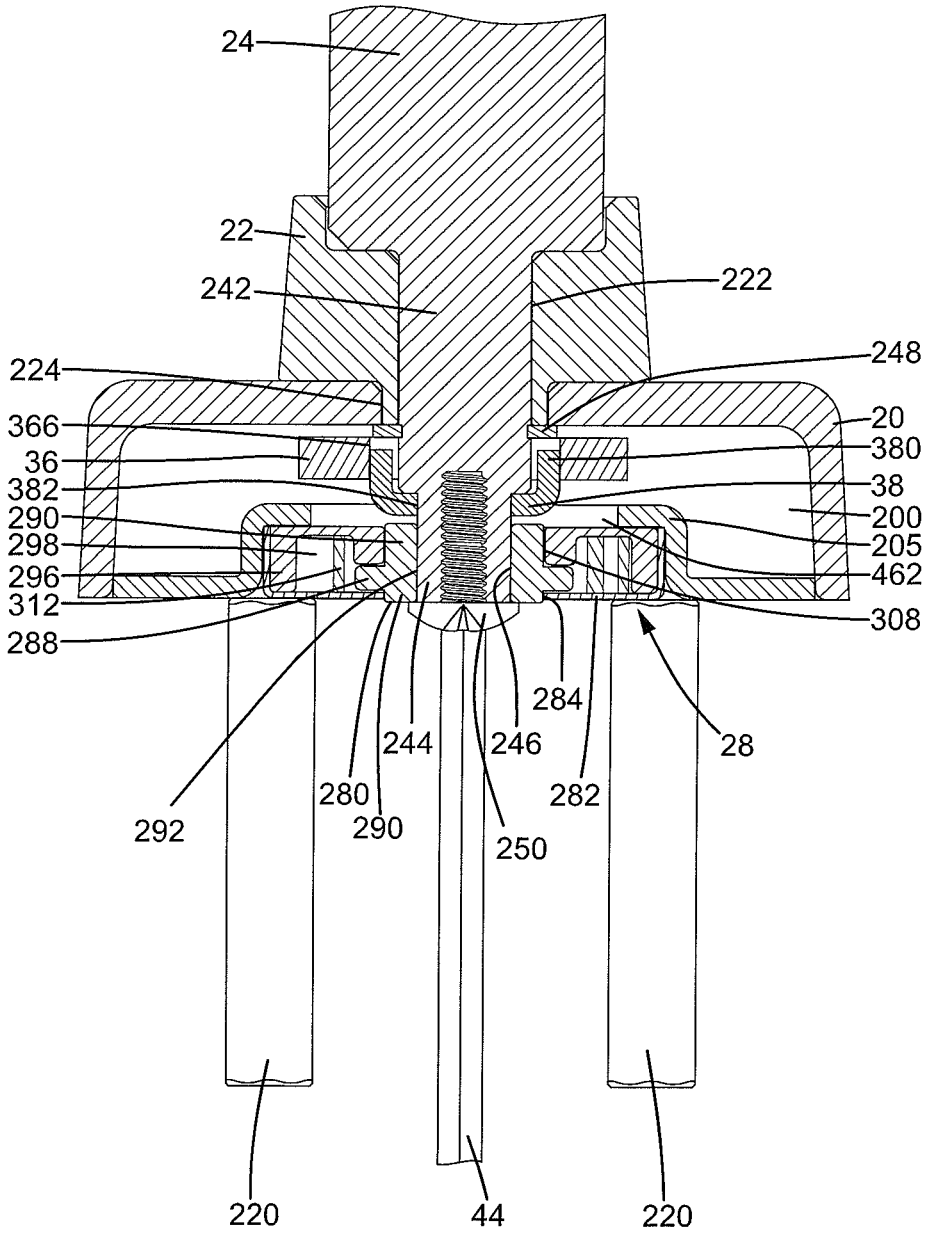
FIG. 8 is a cross sectional view taken along section line 8-8 of FIG. 6.
Figure 9:
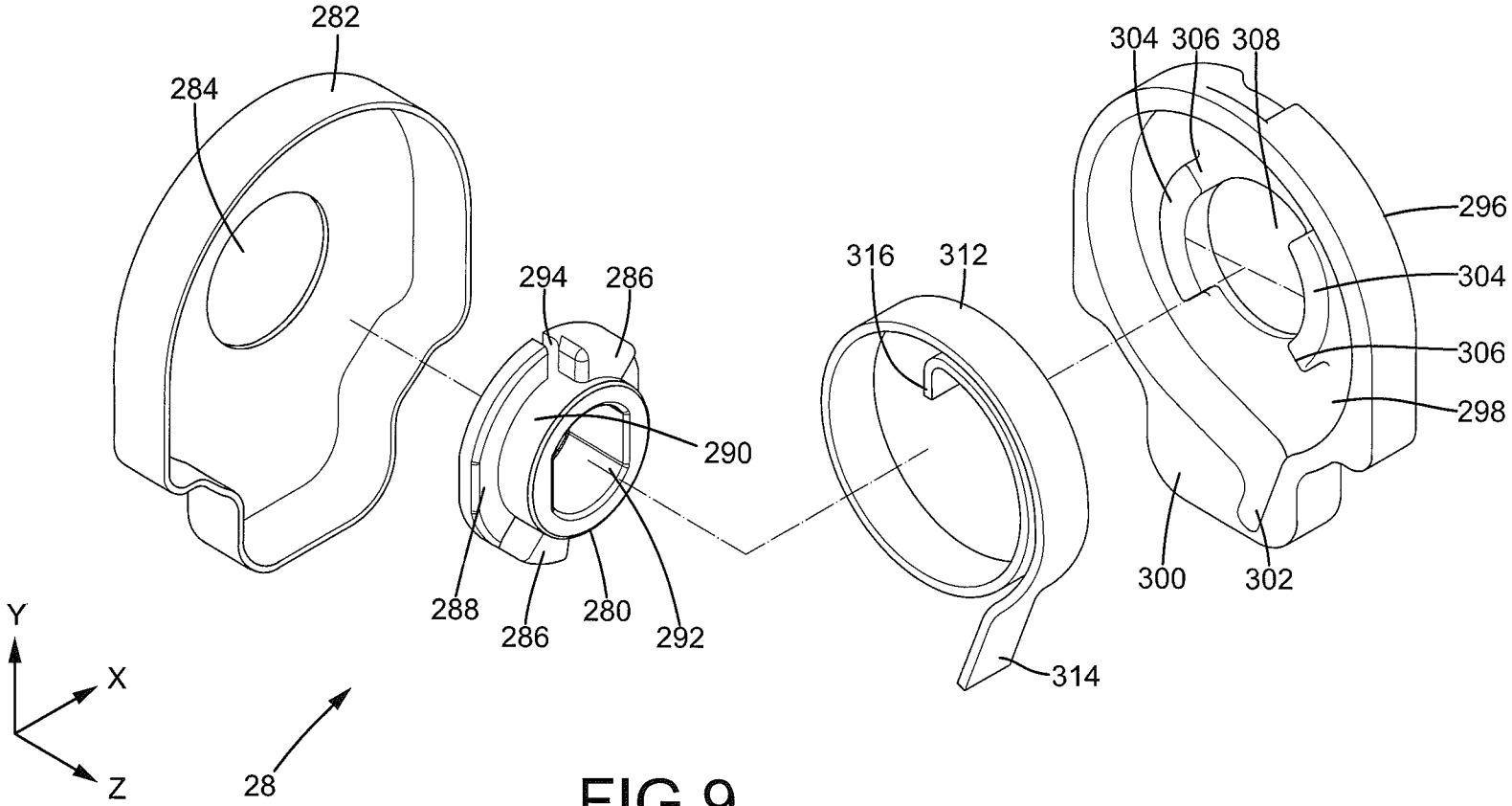
FIG. 9 is an exploded, perspective view of a returning device of the outer operational device of FIG. 4.
Figure 10:
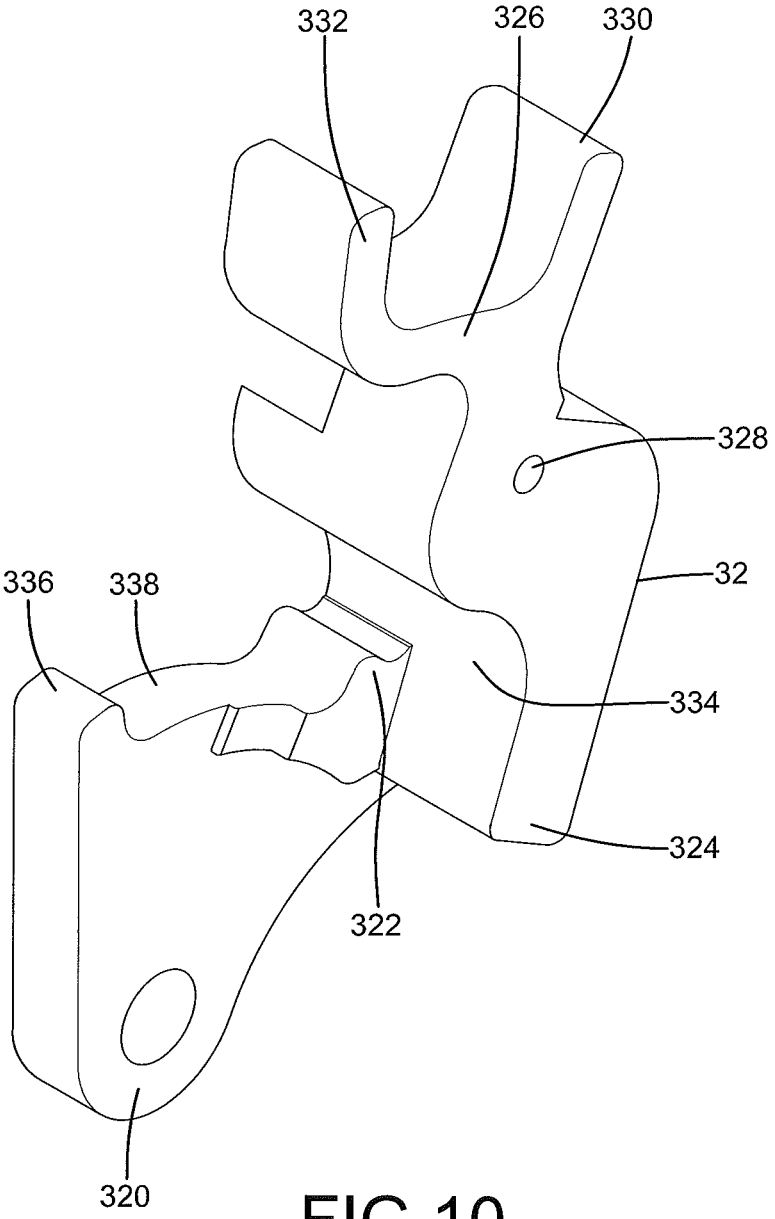
FIG. 10 is a perspective view of a limiting member of the outer operational device of FIG. 4.

According to the form shown, outer operational device 2 further includes an actuating member 36 having a connecting hole 364 in an intermediate portion thereof. Two diametrically opposed rectangular grooves 366 are formed in an inner periphery of connecting hole 364. Actuating member 36 further includes first and second ends 360 and 362 on opposite sides of connecting hole 364. Shank 242 of handle 24 is received in connecting hole 364. Actuating member 36 abuts a side of retainer ring 248 (FIGS. 7 and 8).

According to the form shown, outer operational device 2 further includes a follower 38 in the form of a ring. Follower 38 includes a non-circular hole 382 corresponding to non-circular engaging portion 244 of handle 24 and extending along first axis X. Follower 38 further includes two diametrically opposed teeth 380 extending in a direction parallel to and spaced from a central axis of follower 38. Engaging portion 244 of handle 24 is received in non-circular hole 382 of follower 38, with follower 38 intermediate actuating member 36 and retainer ring 248 and with teeth 380 engaged in grooves 366. Thus, handle 24 and follower 38 can rotate jointly due to non-circular hole 382 and non-circular engaging portion 244. Furthermore, since teeth 380 of follower 38 are engaged in grooves 366 of actuating member 36, rotation of handle 24 also causes rotation of actuating member 36.

According to the form shown, outer operational device 2 further includes a guide block 352 mounted in first groove 216 of cover 20 and having a size corresponding to first groove 216 of cover 20. Guide block 352 includes a sliding groove 353 extending along second axis Y.

According to the form shown, outer operational device 2 further includes an inner lid 46 having an opening 462 through which engaging portion 244 of handle 24 extends. Two bends 466 are formed on an inner periphery of opening 462 and are symmetric to each other. Inner lid 46 further includes two parallel, spaced, elongated slots 460 above opening 462. Inner lid 46 further includes a support 464 below opening 462. Support 464 is formed by bending a portion of inner lid 46 and includes a vertical section 470 and a horizontal section 472. Inner lid 46 abuts protrusion 215 and supports 217, and fasteners 468 extend through inner lid 46 into screw holes in supports 217. Two mounting posts 220 extend through inner lid 46 into screw holes in protrusion 215. Thus, inner lid 46 is fixed in space 200 of cover 20. Vertical section 470 of support 464 abuts two lateral walls of first groove 216 such that guide block 352 can not move in first groove 216 along first axis X. Horizontal section 472 of support 464 abuts end faces of the lateral walls of first groove 216 such that guide block 352 can not move along second axis Y.

According to the form shown, outer operational device 2 further includes a returning device 28 having a body 296 with a non-circular outer periphery. A lobe 300 is formed on a lower end of body 296 and has rectangular cross sections. Body 296 further includes a compartment 298 in a side thereof. Compartment 298 forms an engaging groove 302 in lobe 300. A bottom wall defining compartment 298 includes a pivot hole 308. Two limiting blocks 304 are formed on the side of body 296 along a periphery of pivot hole 308. Each limiting block 304 includes an end 306. Furthermore, each limiting block 304 has a height along first axis X to the side of body 296 smaller than or equal to a depth of compartment 298 along first axis X. A housing 282 slightly larger than body 296 is mounted to the side of body 296 to cover compartment 298. Housing 282 includes an axial hole 284 aligned with pivot hole 308.

According to the form shown, returning device 28 further includes a substantially cylindrical rotatable member 280 having a flange 288 on an intermediate portion of an outer periphery thereof. Two pivotal sections 290 are formed on opposite sides of flange 288. Also formed on the outer periphery of rotatable member 280 are first and second blocks 286 adjacent to two ends of flange 288. A slit 294 is formed between flange 288 and first block 286. Rotatable member 280 further includes a non-circular hole 292 through which engaging portion 244 of handle 24 extends. Pivotal sections 290 are respectively and pivotably received in pivot hole 308 of body 296 and axial hole 284 of housing 282, with first and second blocks 286 located between limiting blocks 304. The spacing between limiting blocks 304 and first and second blocks 286 limits rotation of rotatable member 280.

According to the form shown, returning device 28 further includes an elastic element 312 in the form of a spiral spring having a spiral section, a first tang 314 outside of the spiral section, and a second tang 316 inside of the spiral section. The spiral section of elastic element 312 is mounted around limiting blocks 304 and located in compartment 298, with first tang 314 abutting against a wall of engaging groove 302 and with second tang 316 received in slit 294 of rotatable member 280 and abutting against a side of first block 286 adjacent to slit 294. Thus, first tang 314 is fixed to body 296, and second tang 316 is fixed in slit 294. Rotatable member 280 is biased by elastic element 312 so that each of first and second blocks 286 presses against end 306 of one limiting block 304. In this state, stem 240 of handle 24 is in a horizontal state, and rotatable member 280 is in its initial position. When rotatable member 280 is rotated, first block 286 adjacent to slit 294 presses against second tang 316 of elastic element 312 to store the restoring force.

Returning device 28 is received in opening 462 of inner lid 46 and abuts against bends 466. Lobe 300 is received in second groove 219, such that returning device 28 can not rotate. Engaging portion 244 of handle 24 extends through non-circular hole 292 of rotatable member 280. A fastener 250 is threadedly engaged in a screw hole in an end face of engaging portion 244 and includes a head abutting against rotatable member 280, such that returning device 28 can not move along engaging portion 244. Thus, follower 38 and actuating member 36 are retained in place. Due to the non-circular coupling between engaging portion 244 and rotatable member 280, elastic element 312 is twisted by rotatable member 280 when handle 24 is rotated. When handle 24 is released, elastic element 312 returns rotatable member 280 to its initial position and returns handle 24 to its initial, horizontal position. Limiting blocks 304 limit rotational movement of handle 24 to be about 45° in either direction. In the form shown, handle 24 can rotate 45° in a counterclockwise direction.

According to the form shown, outer operational device 2 further includes a limiting member 32 including a substantially triangular pivotal portion 320. Pivotal portion 320 includes first and second limiting portions 322 and 336 and a groove 338 formed between first and second limiting portions 322 and 336. A stop 324 is formed on a side of pivotal portion 320. Stop 324 has a positioning hole 328 in a face thereof. Stop 324 further includes an arcuate stop face 334 facing first limiting portion 322. Further, stop 324 includes a substantially Y-shaped follower portion 326 on an upper end thereof. Follower portion 326 includes first and second protruded portions 330 and 332.

According to the form shown, outer operational device 2 further includes first and second guide pins 346 and 347 mounted in upper and lower fixing holes 210 of cover 20. Pivotal portion 320 of limiting member 32 is pivotably mounted around second guide pin 347. First guide pin 346 is slideably received in groove 338 between first and second limiting portions 322 and 336. A spring 354 includes a first tang 356 received in positioning hole 212 of cover 20 and a second tang 358 received in positioning hole 328 of stop 324. Limiting member 32 is positioned by resiliency of spring 354.

Figure 6:
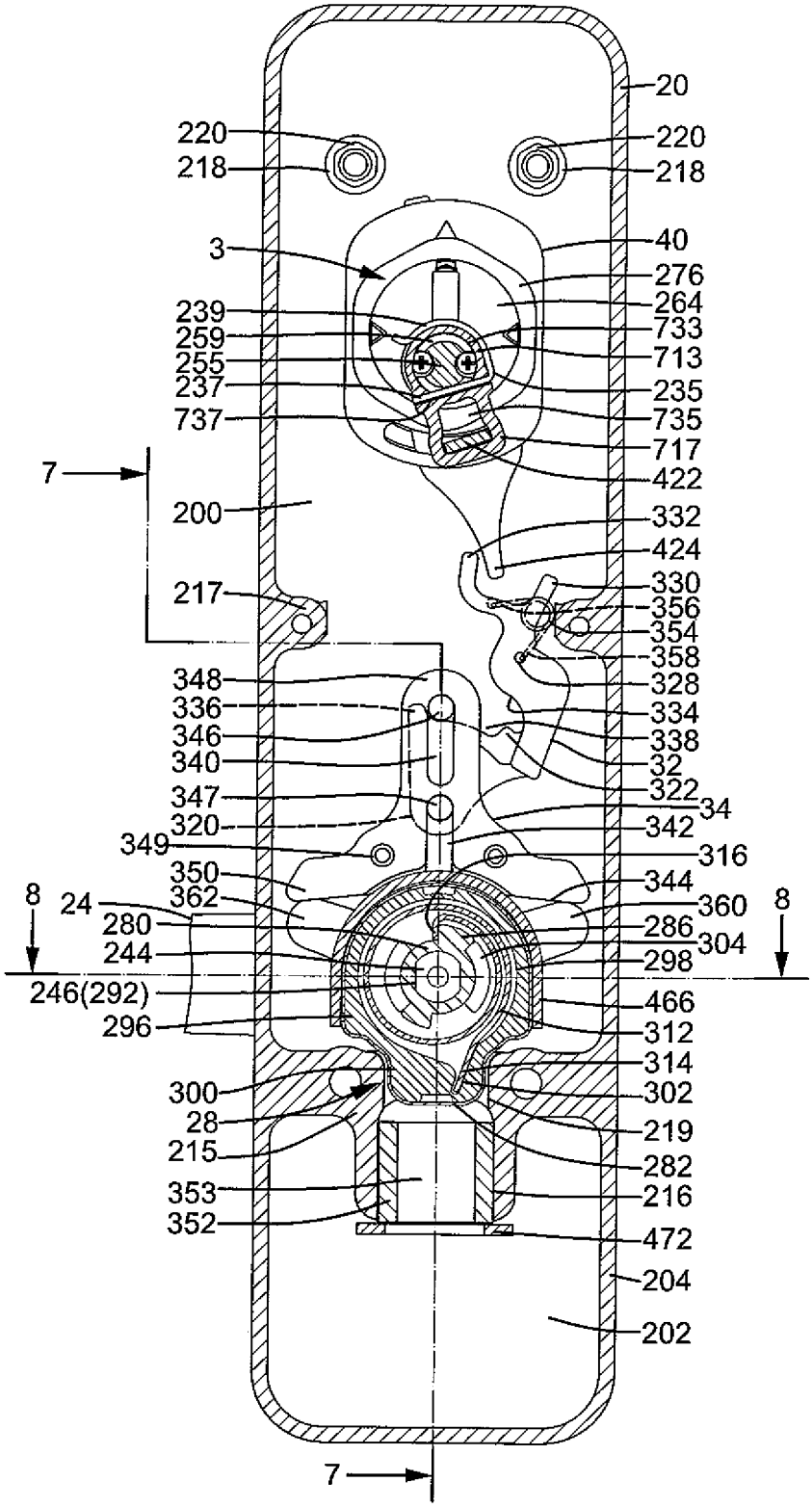
FIG. 6 is a cross sectional view taken along section line 6-6 of FIG. 5.
Figure 11:
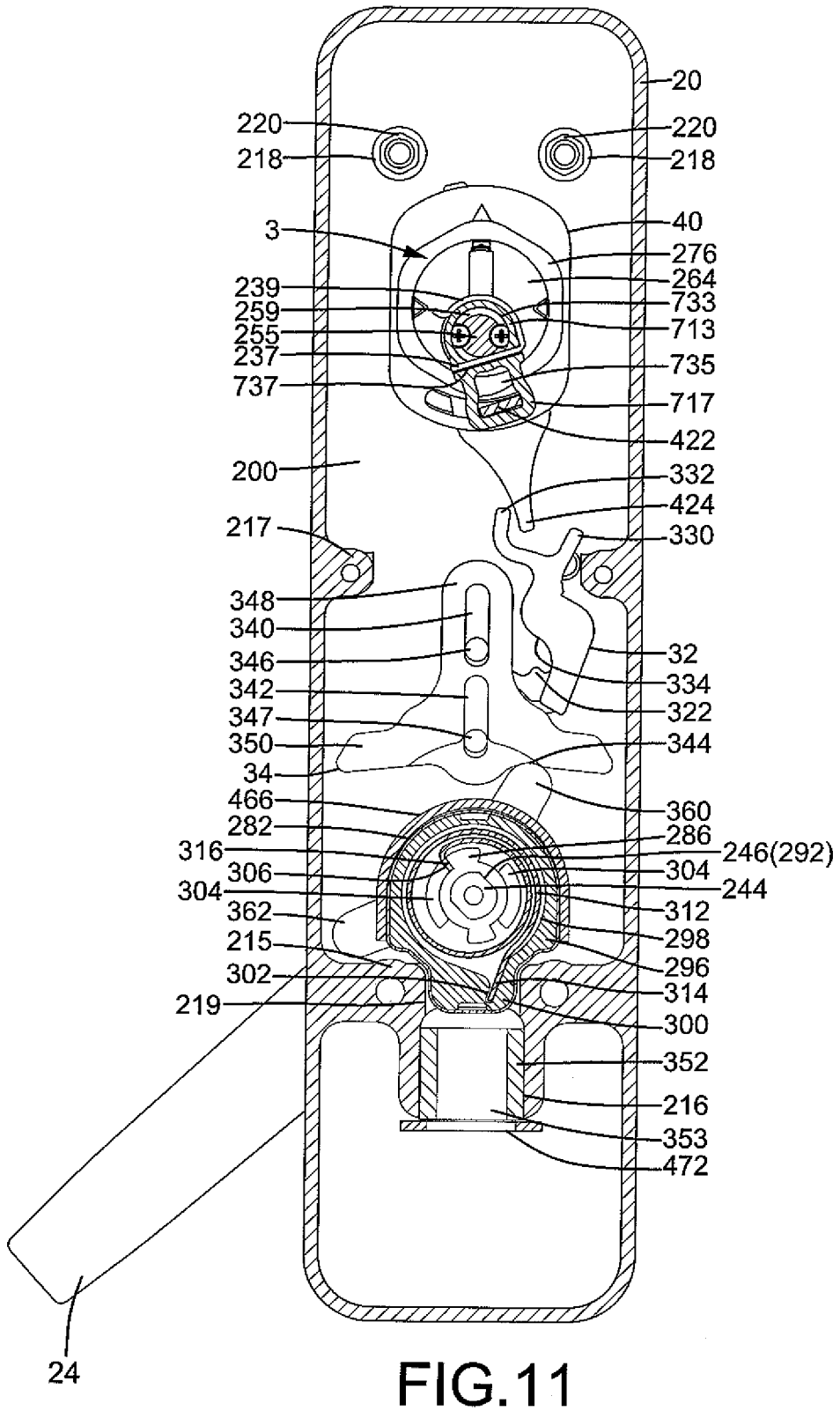
FIG. 11 is a view similar to FIG. 6, with a handle rotated for unlatching purposes.
Figure 12:
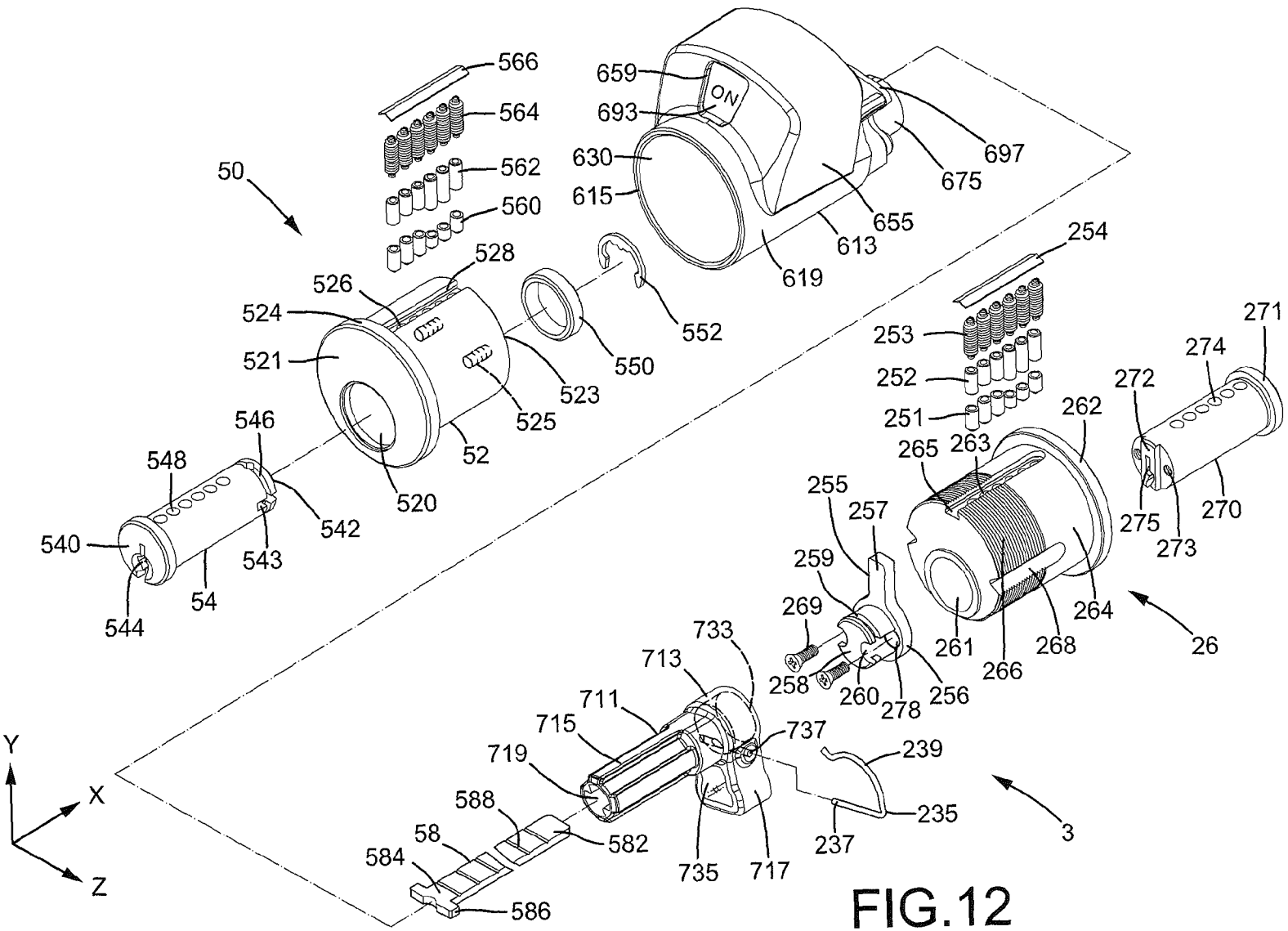
FIG. 12 is an exploded, perspective view of the locking mechanism and an outer cylinder of the panic exit door lock of FIG. 1.

According to the form shown, outer operational device 2 further includes a substantially T-shaped sliding member 34 having a vertical, first section 348 and a substantially horizontal, second section 350. First section 348 includes a first guiding groove 340 and a second guiding groove 342 below first guiding groove 340 along second axis Y. Each of first and second guiding grooves 340 and 342 has a length along second axis Y substantially the same as a length of each elongated slot 460 of inner lid 46 along second axis Y. Second section 350 includes a connecting portion 341 having two pegs 349 each having a screw hole. Furthermore, second section 350 includes a pressing face 344 at a lower end thereof. Sliding member 34 is slideably received in space 200 of cover 20 with pressing face 344 abutting against first and second ends 360 and 362 of actuating member 36. First guide pin 346 extends through first guiding groove 340, and second guide pin 347 extends through second guiding groove 342, so that limiting member 32 can only slide through the length of first and second guiding grooves 340 and 342 along second axis Y. Pegs 349 of connecting portion 341 extend into elongated slots 460 of inner lid 40. Provision of first and second guiding grooves 340 and 342 prevent rotation of sliding member 34 during sliding movement. When rotatable member 280 rotates to a position abutting against the other limiting block 304, actuating member 36 pivots, and one of first and second ends 360 and 362 (depending on the rotating direction of actuating member 36) pushes sliding member 34 upward to an upper position (FIG. 11). When first and second ends 360 and 362 of actuating member 36 are at the same level, sliding member 34 is in its lower position (FIG. 6).

According to the form shown, outer operational device 2 further includes a substantially T-shaped driving member 44 having a base portion 440 extending along first axis X and a rod 442 extending horizontally from an intermediate section of base portion 440. An upper end of base portion 440 is bent to form an engaging portion 448. A lower end of base portion 440 includes a guiding portion 444 that has a shape corresponding to sliding groove 353 of guide block 352 and that is aligned with connecting portion 341 of sliding member 34. Two fasteners 446 extend through holes in engaging portion 448 and elongated slots 460 of inner lid 46 into the screw holes of pegs 349 of connecting portion 341 of sliding member 34. Guiding portion 444 is extended into sliding groove 353 of guide block 35. Thus, driving member 44 and sliding member 34 can move jointly. Elongated slots 460 of inner lid 46 allow movement of fasteners 446. Sliding groove 353 allows stable sliding of guiding portion 444 when rod 442 is subjected to a torque. Rod 442 extends through mounting hole 106 of door 10 and base 130 to a position below slide 141 on lower guiding mechanism 132 along second axis Y.

According to the form shown, locking mechanism 3 further includes an outer cylinder 26 including a cylindrical outer cylinder body 264 having a flange 262 on an end face thereof. Outer cylinder body 264 includes an eccentric bore 261 extending in a longitudinal direction (parallel to first axis X in this embodiment) along an axis parallel to and spaced from a central, longitudinal axis of outer cylinder body 264. An end of an outer periphery of outer cylinder body 264 includes a threaded portion 266. The outer periphery of outer cylinder body 264 further includes two diametrically opposed V-shaped positioning grooves 268. The outer periphery of outer cylinder body 264 further includes a longitudinal groove 265 extending in the longitudinal direction and parallel to and spaced from bore 261. Longitudinal groove 265 is spaced from each positioning groove 268 by 90° in the form shown. A plurality of upper tumbler pin holes 263 extends from a bottom wall of longitudinal groove 265 to bore 261 along second axis Y. Upper tumbler pin holes 263 are spaced from each other in the longitudinal direction.

According to the form shown, locking mechanism 3 further includes an outer lock core 270 received in outer cylinder body 264. Outer lock core 270 includes an enlarged head 271 on an end thereof and a tail 272 on the other end thereof, with tail 272 having a diameter smaller than that of enlarged head 271. Outer lock core 270 further includes a keyway 275 extending from head 271 through tail 272. Outer lock core 270 further includes a plurality of lower tumbler pin holes 274 in an outer periphery thereof. Lower tumbler pin holes 274 are spaced from each other in the longitudinal direction. Each lower tumbler pin hole 274 extends from the outer periphery of outer lock core 270 to keyway 275. Two screw holes 273 are provided in an end face of tail 272. Outer lock core 270 is rotatably received in bore 261 of outer cylinder body 264, with tail 272 located outside of bore 261 and with head 271 abutting an end of bore 261, such that each lower tumbler pin hole 274 is aligned with one upper tumbler pin hole 263.

According to the form shown, locking mechanism 3 further includes an actuating block 255 mounted to tail 272 of outer lock core 270. Specifically, actuating block 255 includes a main portion 256 having an ear 257 extending radially outward from an outer periphery of main portion 256. A coupling portion 258 extends from a side of main portion 256 along first axis X and includes an annular groove 259 in the outer periphery thereof. In the form shown, coupling portion 258 includes two diametrically opposed, longitudinal grooves 260, and main portion 256 includes two through-holes 278 aligned with longitudinal grooves 260. Two fasteners 269 are received in grooves 260 and extend through through-holes 278 into screw holes 273 of outer lock core 270, so that actuating block 255 and outer lock core 270 can rotate jointly about the axis of bore 261. Actuating block 255 prevents outer lock core 270 from disengaging from outer cylinder 26 through movement along the axis of bore 261.

According to the form shown, a lower tumbler pin 251, an upper tumbler pin 252, and a spring 253 are received in each pair of aligned upper and lower tumbler pin holes 263 and 274. A lid 254 is mounted in longitudinal groove 265 to prevent disengagement of upper and lower tumbler pins 252 and 251 and springs 253. Each spring 253 includes a first end pressing against lid 254 and a second end pressing against one upper tumbler in 252, assuring reliable contact between a pair of aligned upper and lower tumbler pins 252 and 251 and assuring lower tumbler pin 251 extending into keyway 275. Furthermore, each upper tumbler pin 252 normally extends into one [[oll] lower tumbler pin ['holes]] hole 274. Thus, outer lock core 270 can not rotate in bore 261 without a key 60. Upper tumbler pins 252 have differing lengths, and lower tumbler pins 251 have differing lengths, providing numerous combinations of keys.

According to the form shown, outer cylinder 26 is received in compartment 206 of cover 20, with flange 262 abutting a bottom wall of compartment 206. Outer cylinder body 264 extends through opening 208 into mounting hole 106 of door 10.

According to the form shown, outer operational device 2 further includes a mover 42 having a circular hole 420. Mover 42 includes a limiting bar 426 extending upward from an upper end thereof and an actuating bar 424 extending downward from a lower end thereof. A tab 422 extends perpendicularly from actuating bar 424. Mover 42 is rotatably mounted around outer cylinder body 264.

According to the form shown, outer operational device 2 further includes a lid 40 in the form of a thin shell. Specifically, lid 40 includes two lateral walls 410 and an interconnecting wall 412 interconnected between lateral walls 410. A hole 402 is defined in interconnecting wall 412 and has a shape corresponding to body 264 of cylinder 26. Two diametrically opposed projections 406 are formed on an inner periphery of hole 402. Interconnecting wall 412 further includes an arcuate limiting groove 404 below hole 402 along second axis Y. Lid 40 further includes an upper notch 408 in a top thereof between upper ends of lateral walls 410 and a lower notch 408 in a bottom thereof between lower ends of lateral walls 410. Lid 40 is mounted around outer cylinder body 264 of outer cylinder 26, with projections 406 engaged in positioning grooves 268 and with lateral walls 410 abutting chamfered faces 209 of receiving portion 205, so that outer cylinder 26 can not rotate and so that lid 40 can not rotate relative to receiving portion 205. A washer 276 with inner threading is threadedly engaged around threaded portion 266 and abuts a face of interconnecting wall 412 of lid 40, preventing lid 40 from moving along the longitudinal direction of outer cylinder body 264 parallel to first axis X. Furthermore, mover 42 is rotatably mounted between cover 20 and washer 276.

According to the form shown, limiting bar 426 of mover 42 extends beyond upper notch 408 of lid 40, and actuating bar 424 extends beyond lower notch 408 of lid 40. Furthermore, tab 422 of mover 42 extends beyond limiting groove 404 of lid 40. Thus, rotational movement of mover 42 is limited by upper and lower notches 408 and limiting groove 404. Actuating bar 424 is located between first and second protruded portions 330 and 332 of limiting member 32. Tab 422 is located in a path of rotational movement of actuating block 255, so that mover 42 rotates when actuating block 255 comes in contact with and drives tab 422.

According to the form shown, locking mechanism 3 includes an inner cylinder 50 including inner cylinder body 52 having front and rear end faces 521 and 523 and an eccentric bore 520 extending from front end face 521 through rear end face 523 in the longitudinal direction along an axis parallel to and spaced from a central, longitudinal axis of inner cylinder body 52. A flange 524 is formed on front end face 521. Two screw holes 525 are formed in rear end face 523. Inner cylinder body 52 further includes a longitudinal groove 528 in an outer periphery thereof. Longitudinal groove 528 extends in the longitudinal direction and parallel to and spaced from bore 520. A plurality of upper tumbler pin holes 526 extends from a bottom wall of longitudinal groove 528 to bore 520 along second axis Y and is spaced in the longitudinal direction parallel to first axis X. An inner lock core 54 is received in bore 520 and includes an enlarged head 540 on an end thereof and a tail 542 on the other end thereof, with tail 542 having a diameter smaller than that of enlarged head 540. Tail 542 includes an annular groove 546 in an outer periphery thereof. Tail 542 further includes a groove 543 extending from an end face of tail 542 toward but spaced from head 540 in the longitudinal direction and intersecting and in communication with annular groove 546. Inner lock core 54 further includes a keyway 544 extending from head 540 through tail 542. Inner lock core 54 further includes a plurality of lower tumbler pin holes 548 in the outer periphery thereof. Lower tumbler pin holes 548 are spaced from each other in the longitudinal direction parallel to first axis X. Each lower tumbler pin hole 548 extends from the outer periphery of inner lock core 54 to keyway 544 along second axis Y. Inner lock core 54 is rotatably received in bore 520 of inner cylinder body 52, with tail 542 located outside of bore 520 and with head 540 abutting an end of bore 520, such that each lower tumbler pin hole 548 is aligned with one upper tumbler pin hole 526.

According to the form shown, a lower tumbler pin 560, an upper tumbler pin 562, and a spring 564 are received in each pair of aligned upper and lower tumbler pin holes 526 and 548. A lid 566 is mounted in longitudinal groove 528 to prevent disengagement of upper and lower tumbler pins 562 and 560 and springs 564. Each spring 564 includes a first end pressing against lid 566 and a second end pressing against one upper tumbler pin 562, assuring reliable contact between a pair of aligned upper and lower tumbler pins 562 and 560 and assuring lower tumbler pin 560 extending extends into keyway 544. Furthermore, each upper tumbler pin 562 normally extends into one lower tumbler pin hole 548. Thus, inner lock core 540 can not rotate in bore 520 without a key 60. Upper tumbler pins 562 have differing lengths, and lower tumbler pins 560 have differing lengths, providing numerous combinations of keys.

Figure 13:
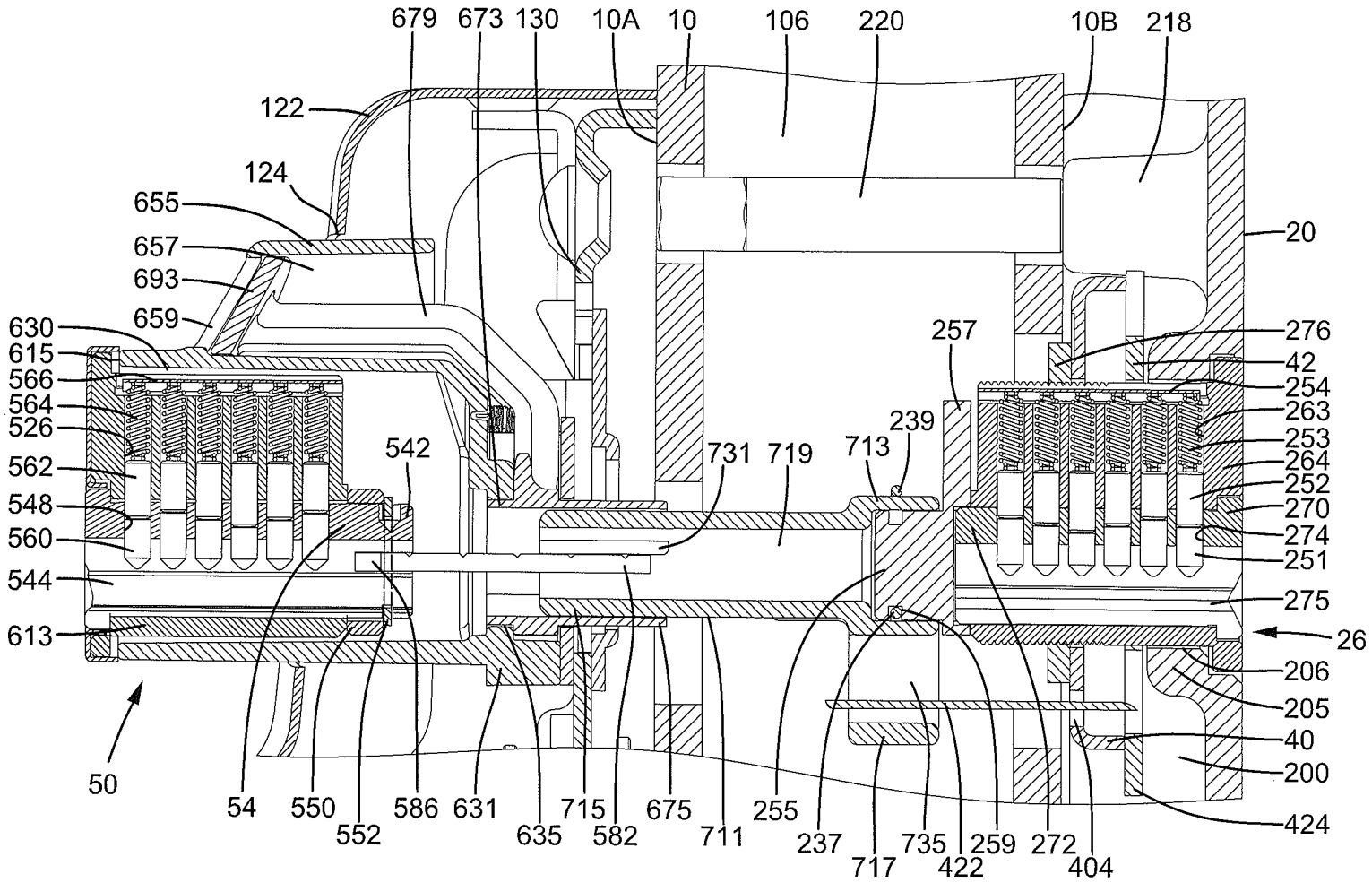
FIG. 13 is a cross sectional view taken along section line 13-13 of FIG. 3.

According to the form shown, locking mechanism 3 further includes a tongue 58 having front and rear ends 582 and 584 spaced from each other in the longitudinal direction parallel to first axis X. Rear end 584 includes an ear 586 on each of two sides thereof. Each ear 586 has a width slightly smaller than a diameter of tail 542 of inner lock core 54. Tongue 58 includes an upper face with a plurality of slots 588 located between front and rear ends 582 and 584 and spaced from each other at regular intervals. Ears 586 of rear end 584 are received in groove 543 of inner lock core 54. A positioning ring 550 is mounted around inner lock core 54 between groove 543 and lower tumbler pin holes 548. A retainer ring 552 is engaged in annular groove 546 of inner lock core 54 to position positioning ring 550 between retainer ring 552 and rear end face 523 of inner cylinder body 52. Positioning ring 550 prevents ears 586 of tongue 58 from extending out of groove 543 of inner lock core 54. Retainer ring 552 retains ears 586 of tongue 58 in a position behind annular groove 546, preventing tongue 58 from disengaging from groove 543 of inner lock core 54. Thus, tongue 58 is reliably fixed to inner lock core 54 (FIG. 13).

According to the form shown, locking mechanism 3 further includes an inner cylinder seat 613 receiving inner cylinder 50. Inner cylinder seat 613 includes a first end face 615 and a second end face 617 spaced from first end face 615 along first axis X. Inner cylinder seat 613 further includes a peripheral wall 619 extending from first end face 615 through second end face 617 along first axis X. Inner cylinder seat 613 further includes a first compartment 630 extending from first end face 615 through second end face 617. A shield 655 is provided on peripheral wall 619 and defines a second compartment 657. Shield 655 includes a wall adjacent to first end face 615. A window 659 is defined in the wall of shield 655. Window 659 extends to and is in communication with second compartment 657. Inner cylinder seat 613 further includes a pivotal portion 631 extending from second end face 617 away from first end face 615 along first axis X. Pivotal portion 631 includes a third end face 633, with the second end face 617 located between first end face 615 and third end face 633 along first axis X. Pivotal portion 631 further includes a pivotal hole 635 extending from third end face 633 to first compartment 630 along first axis X. Pivotal portion 631 further includes a notch 638 formed in an upper end of pivotal portion 631 and extending to pivotal hole 635. An engagement hole 653 is defined in second end face 617. Two screw holes 654 are defined in second end face 617 and are located on two sides of notch 638, with a longitudinal axis of pivotal hole 635 located between screw holes 654. Flange 524 of inner cylinder body 52 abuts first end face 615 of inner cylinder seat 613. Tongue 58 extends outside of third end face 633 of inner cylinder seat 613.

Figure 3:
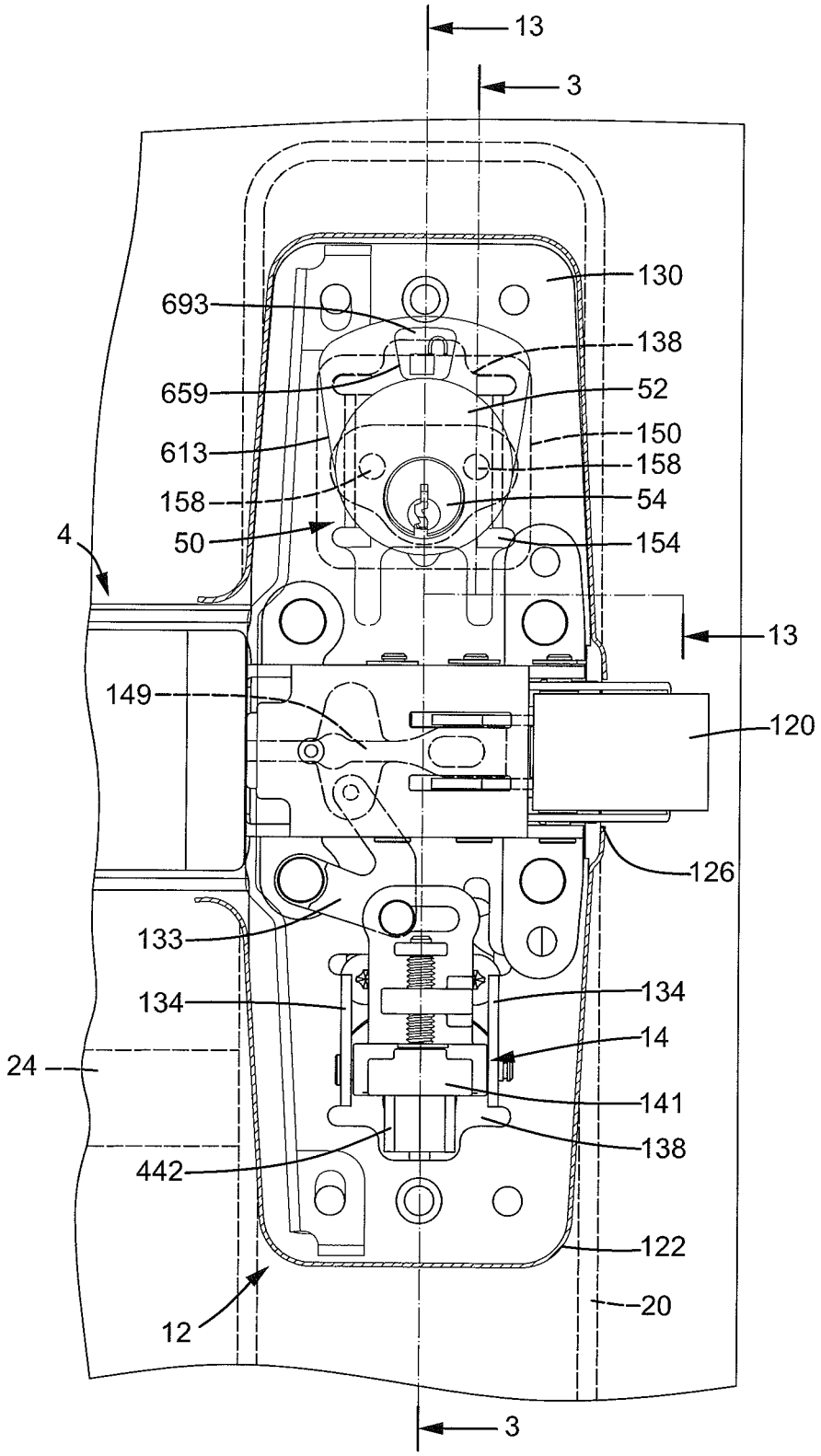
FIG. 3 is a side view of the panic exit door lock of FIG. 1 and a door to which the panic exit door lock is mounted.
Figure 4:
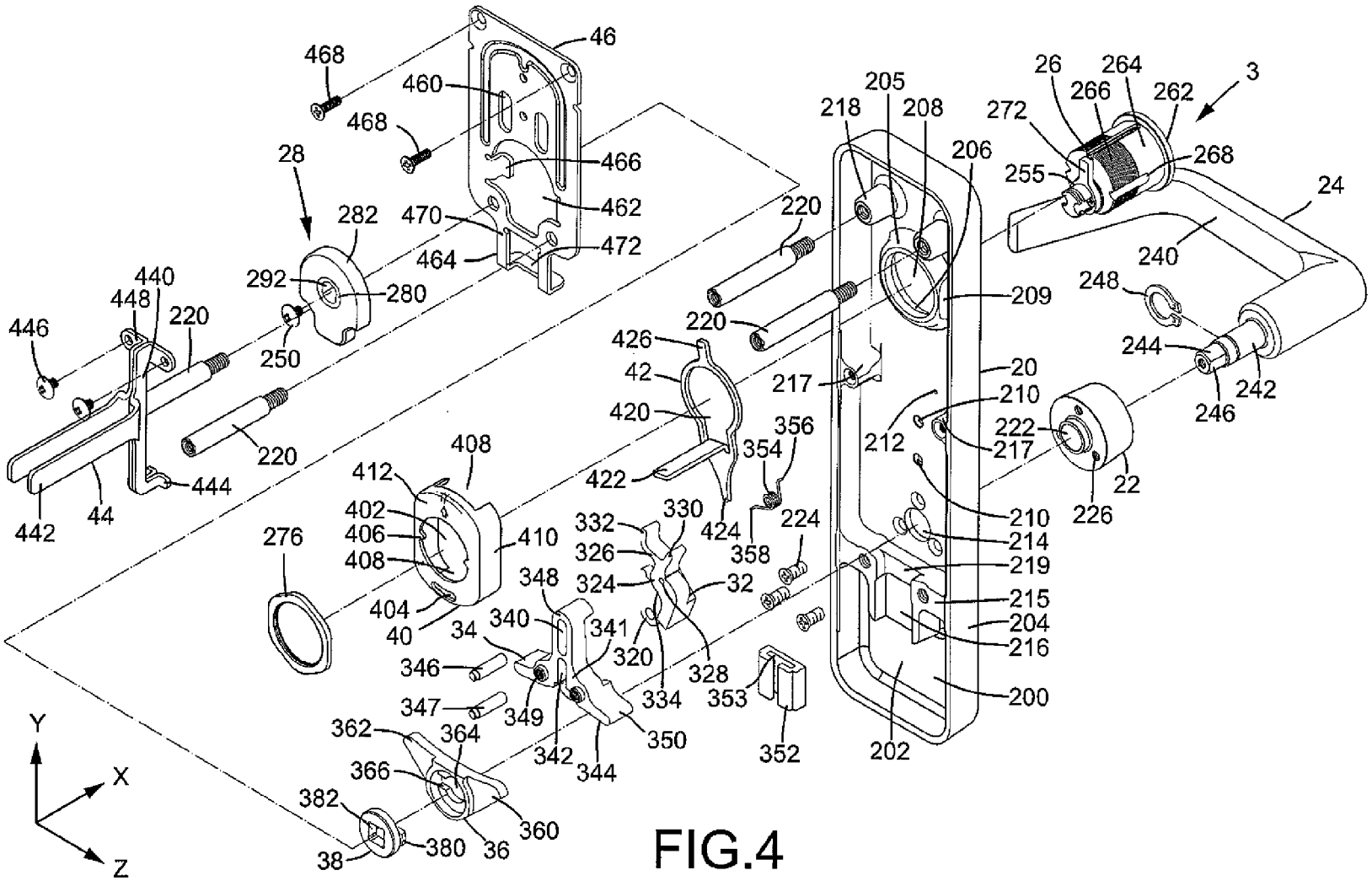
FIG. 4 is an exploded, perspective view of an outer operational device of the panic exit door lock of FIG. 1.

With reference to FIGS. 1-13, inner cylinder 50 is fixed by a locking plate 150 to upper guiding mechanism 132 of base 130. According to the form shown, locking plate 150 is mounted to the other side of base 130 facing door 10 and is aligned with upper guiding mechanism 132. Specifically, locking plate 150 includes two holes 152 aligned with screw holes 654 of inner cylinder seat 613. Locking plate 150 further includes a through-hole 156 between holes 152. Furthermore, locking plate 150 includes a plurality of protrusions 154 in four corners of locking plate 150. Protrusions 154 are inserted into four corners of slot 138 of upper guiding mechanism 132 to position locking plate 150 (FIG. 3). Second end face 617 of inner cylinder seat 613 abuts distal ends of tabs 134 of upper guiding mechanism 132. Two screws 158 extend through holes 152 of locking plate 150 and screw holes 654 of inner cylinder seat 613 into screw holes 525 of inner cylinder body 52. Thus, inner cylinder 50 and locking plate 150 are fixed to upper guiding mechanism 132, with tongue 58 extending through through-hole 156 of locking plate 150.

According to the form shown, locking mechanism 3 further includes a driving block 711 pivotably connected to actuating block 255. Driving block 711 includes a sleeve portion 713 and a connection portion 715 extending from a side of sleeve portion 713 along first axis X. Connection portion 715 has non-circular cross sections. Driving block 711 further includes a flange 717 formed on an outer periphery of sleeve portion 713 and having an actuating hole 735. Sleeve portion 713 includes a receiving hole 733 extending from the other side of sleeve portion 713 toward but spaced from connection portion 715 along first axis X. An engagement hole 737 extends from the outer periphery of sleeve portion 713 to receiving hole 733. Connection portion 715 includes a distal end. Connection portion 715 further includes a coupling hole 719 extending from the distal end of connection portion 715 toward but spaced from sleeve portion 713. Two inner protrusions 731 are formed on an inner periphery of coupling hole 719, are rib-like, and are spaced from each other in a diametric direction. Coupling portion 258 of actuating block 255 is pivotably coupled in receiving hole 733 of driving block 711, with engagement hole 737 of driving block 711 aligned with annular groove 259 of actuating block 255. Tab 422 of mover 42 is located in actuating hole 735 of driving block 711. Thus, mover 42 and driving block 711 can pivot jointly.

According to the form shown, locking mechanism 3 further includes a substantially V-shaped resilient clip 235 having first and second ends 237 and 239. First end 237 of resilient clip 235 extends through engagement hole 737 of driving block 711 into annular groove 259 of actuating block 255. Second end 239 of resilient clip 235 abuts the outer periphery of sleeve portion 713 of driving block 711, preventing driving block 711 from moving along a longitudinal axis of coupling portion 258 of actuating block 255. However, since groove 259 of actuating block 255 is annular, driving block 711 can rotate about coupling portion 258. Resilient clip 235 can be easily removed when it is desired to disengage driving block 711 from actuating block 255.

Figure 5:
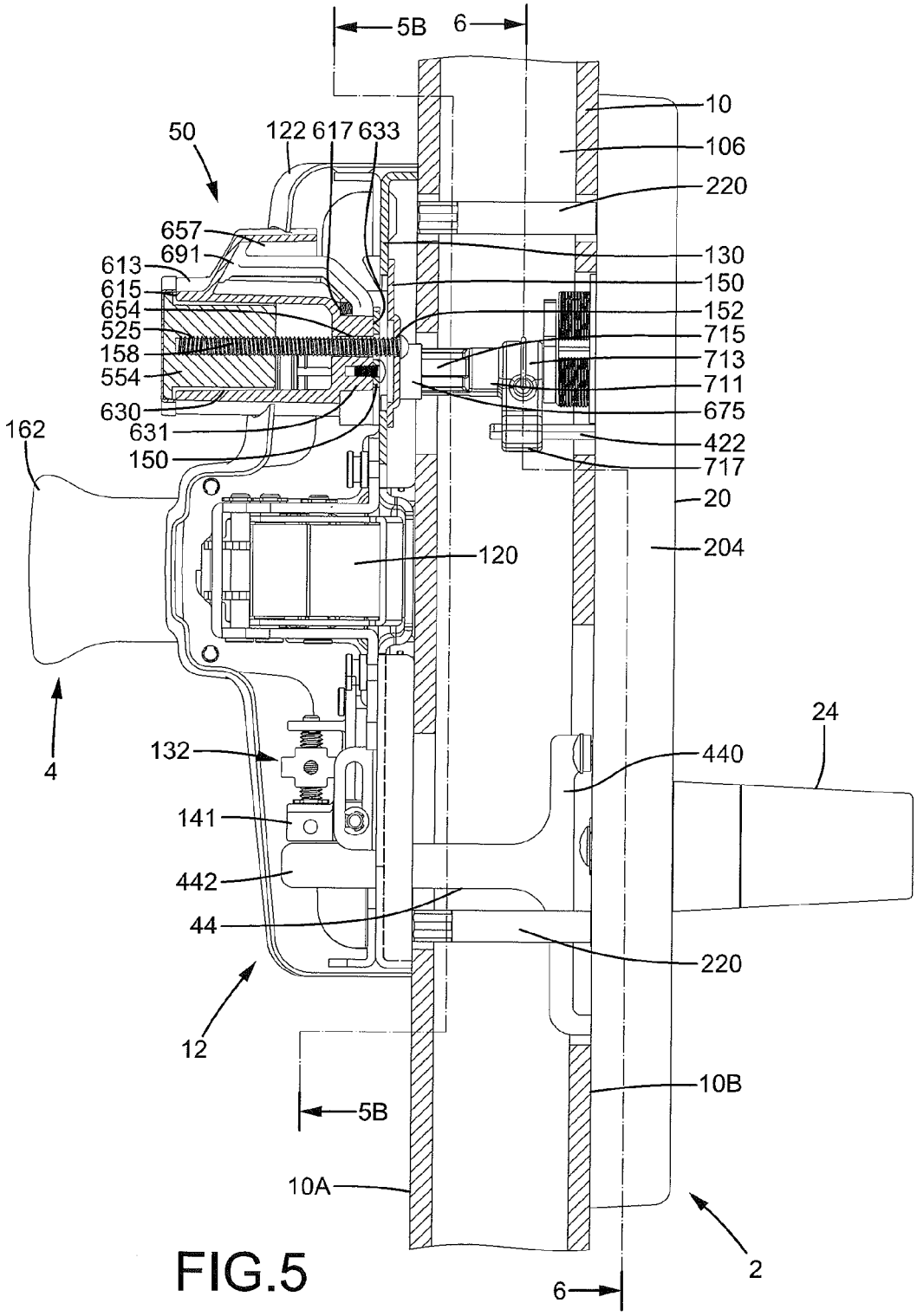
FIG. 5 is a cross sectional view taken along section line 5-5 of FIG. 3.

With reference to FIG. 5, front end 582 of tongue 58 extends through mounting hole 106 of door 10 into coupling hole 719 of driving block 711. Since coupling hole 719 is non-circular, tongue 58 and driving block 711 can rotate jointly when tongue 58 pivots to a position pressing against inner protrusions 731. Any slot 588 of tongue 58 can be broken to shorten the length of tongue 58 along first axis X according to the thickness of door 10.

According to the form shown, locking mechanism 3 further includes an indicator member 660 coupled to driving block 711. Indicator member 660 includes a pivotal portion 671 having a first section 673 and a second section 675 spaced from first section 673 along first axis X. Pivotal portion 671 further includes an engagement hole 677 extending from an end face of first section 673 toward but spaced from an end face of second section 675 along first axis X. Engagement hole 677 has non-circular cross sections. Indicator member 660 further includes an arm 679 formed on an outer periphery of pivotal portion 671. An indicator 691 is formed on a distal end of arm 679 and includes a first portion 693 indicating limiting member 32 is in the release position and a second portion 695 indicating limiting member 32 is in the blocking position. First section 673 of indicator member 660 is pivotably received in pivotal hole 635 of inner cylinder seat 613. Second section 675 of indicator member 660 is mounted around connection portion 715 of driving block 711. Due to the non-circular coupling between second section 675 of indicator member 660 and connection portion 715 of driving block 711, indicator member 660 and driving block 711 can pivot jointly. Pivotal movement of indicator member 660 between two positions causes selective alignment of first portion 693 or second portion 695 of indicator 691 with window 659.

According to the form shown, a spring 739 is mounted between indicator member 660 and inner cylinder seat 613. Spring 739 includes a first tang 751 and a second tang 753. First tang 751 of spring 739 is engaged in engagement hole 653 of inner cylinder seat 613. Second tang 753 of spring 739 presses against arm 679 of indicator member 660. Spring 739 biases indicator member 660 to a position in which first portion 693 or second portion 695 of indicator member 660 is aligned with window 659. A limiting plate 697 is screwed to third end face 633 of inner cylinder seat 613 and includes a through-hole 699 aligned with pivotal hole 635 of inner cylinder seat 613. Second section 675 of indicator member 660 extends through through-hole 699 of limiting plate 697 and engages with driving block 711, preventing indicator member 660 from moving along first axis X.

Figure 5A:
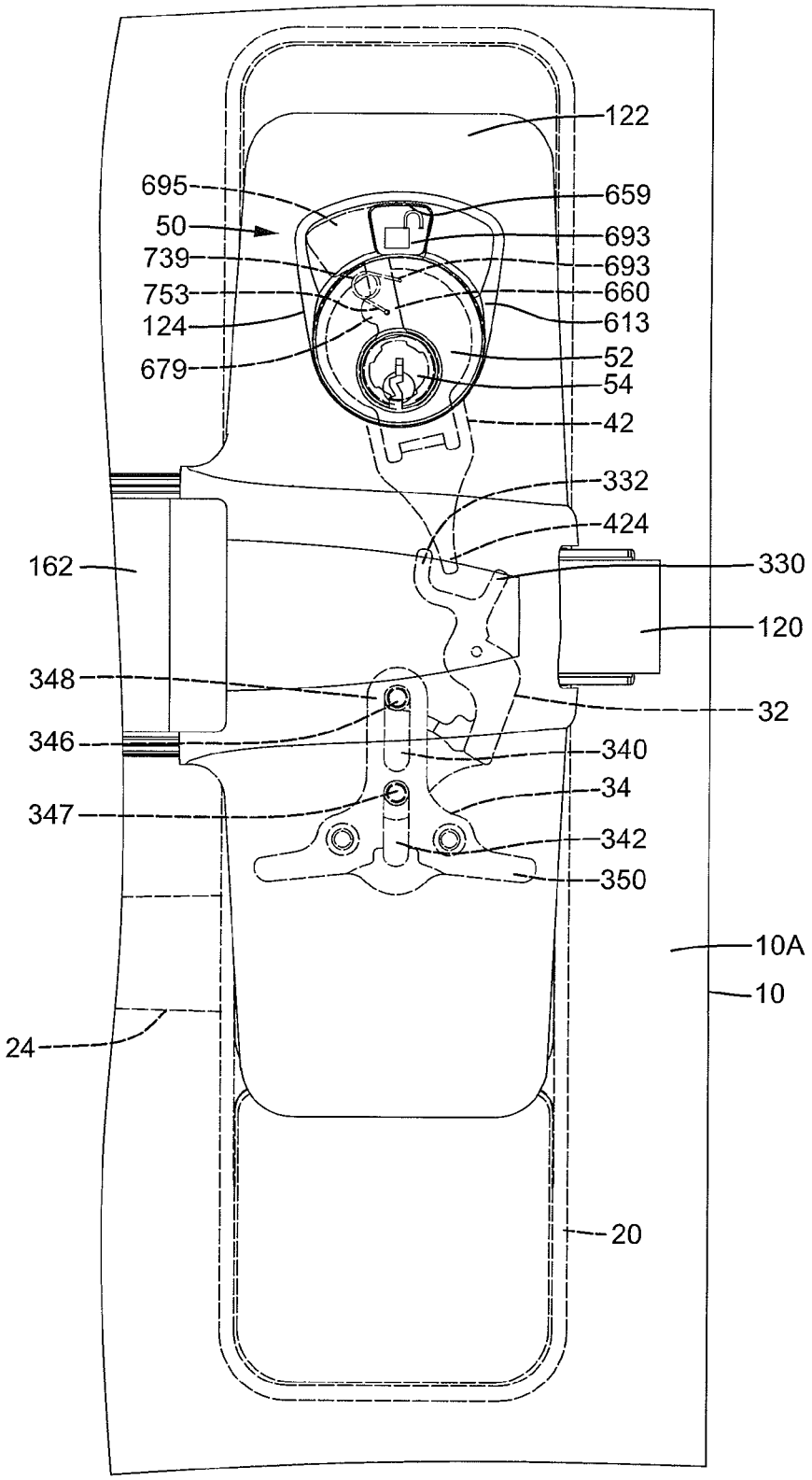
FIG. 5A is a left side view of the panic exit door lock and the door of FIG. 5.
Figure 5B:
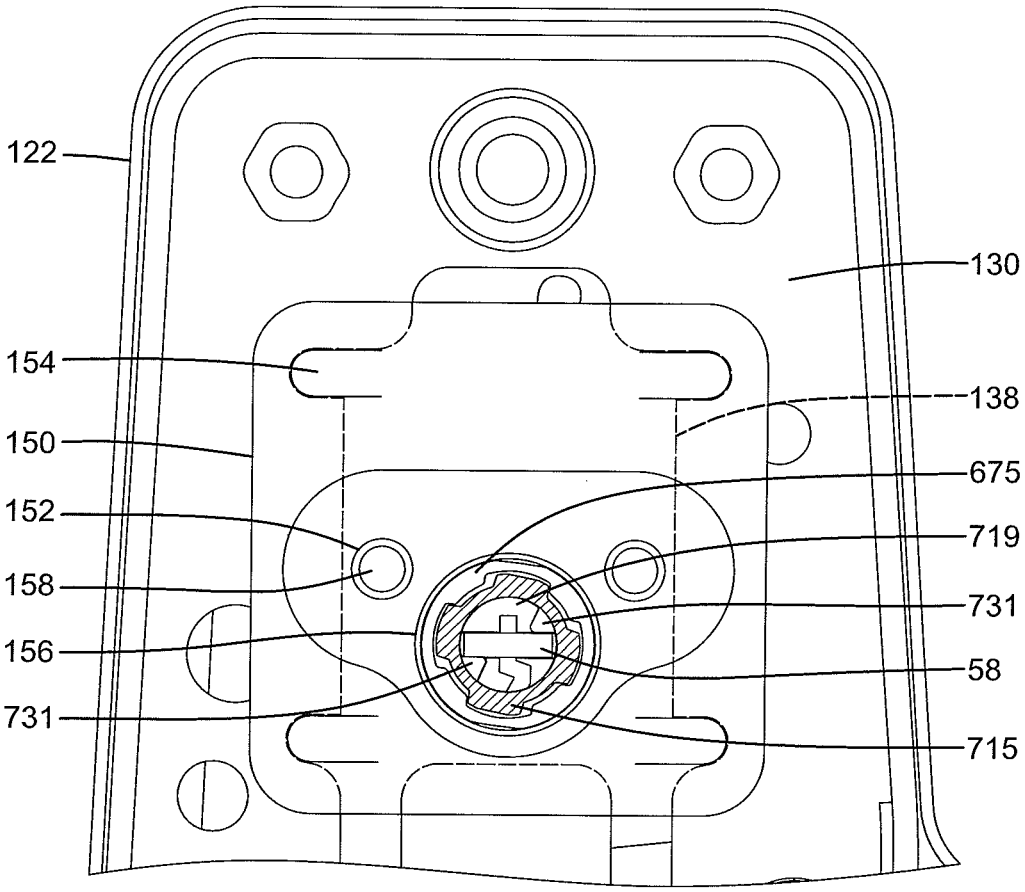
FIG. 5B is a cross sectional view taken along section line 5B-5B of FIG. 5.

Now that the basic construction of the panic exit door lock of the present invention has been explained, the operation and some of the advantages of locking mechanism 3 can be set forth and appreciated. In particular, for the sake of explanation, it will be assumed that handle 24 is in a horizontal position (FIGS. 5, 5A, and 6). A locking function of locking mechanism 3 has not been set yet. First portion 693 of indicator 691 of indicator member 660 is aligned with window 659 of inner cylinder seat 613 (FIG. 5A). Thus, a user can be aware of an unlocking state of locking mechanism 3 through window 659.

When handle 24 is rotated, follower 38 and rotatable member 280 of returning device 28 rotate jointly with engaging portion 244, so that first block 286 moves second tang 316 of elastic element 312 and so that elastic element 312 is twisted to store potential energy for returning purposes. Actuating member 36 is driven by follower 38 to rotate in a direction (see FIG. 11). When handle 24 is rotated counterclockwise, first end 360 of actuating member 36 rotates upward whereas second end 362 of actuating member 36 rotates downward. First end 360 of actuating member 36 presses against pressing face 344 of sliding member 34, so that sliding member 34 moves upward along first and second guide pins 346 and 347. At the same time, driving member 44 is carried upward by sliding member 34. When first block 286 is rotated from its initial position to an extreme position abutting against end 306 of the other limiting block 304, driving member 44 is moved from the lower position to the upper position where stem 240 of handle 24 is at an angle of 45° to the horizontal plane. During movement of driving member 44 from the lower position to the upper position, slide 141 is pressed against and is, thus, moved by rod 442 of mover 42, moving latch 120 to the retracted position.

When handle 24 is released after unlatching, second tang 316 of elastic element 312 returns rotatable member 280 from the extreme position back to the initial position, which in turn, rotates handle 24 in a clockwise direction in FIG. 11 to its initial position via engaging portion 244. Thus, stem 240 of handle 24 returns to its horizontal position, and first and second ends 360 and 362 of actuating member 36 are at the same level. At the same time, sliding member 34 moves downward under the action of gravitational force until both first and second ends 360 and 362 of actuating member 36 abut pressing face 344. Furthermore, driving member 44 is carried by sliding member 34 to the lower position. Slide 141 is returned by a returning device to a position shown in FIG. 5.

It can be appreciated that the panic exit door lock according to the present invention can provide a locking function through a setting operation from either outer side 10B or inner side 10A of door 10. Specifically, when the locking function is not set, limiting member 32 is biased by spring 354 to a release position away from sliding member 34. In this case, second limiting portion 336 abuts against first guide pin 346, actuating bar 424 of mover 42 abuts against second protruded portion 332 of limiting member 32, handle 24 is in the horizontal state, and sliding member 34 is in the lower position.

Figure 14:
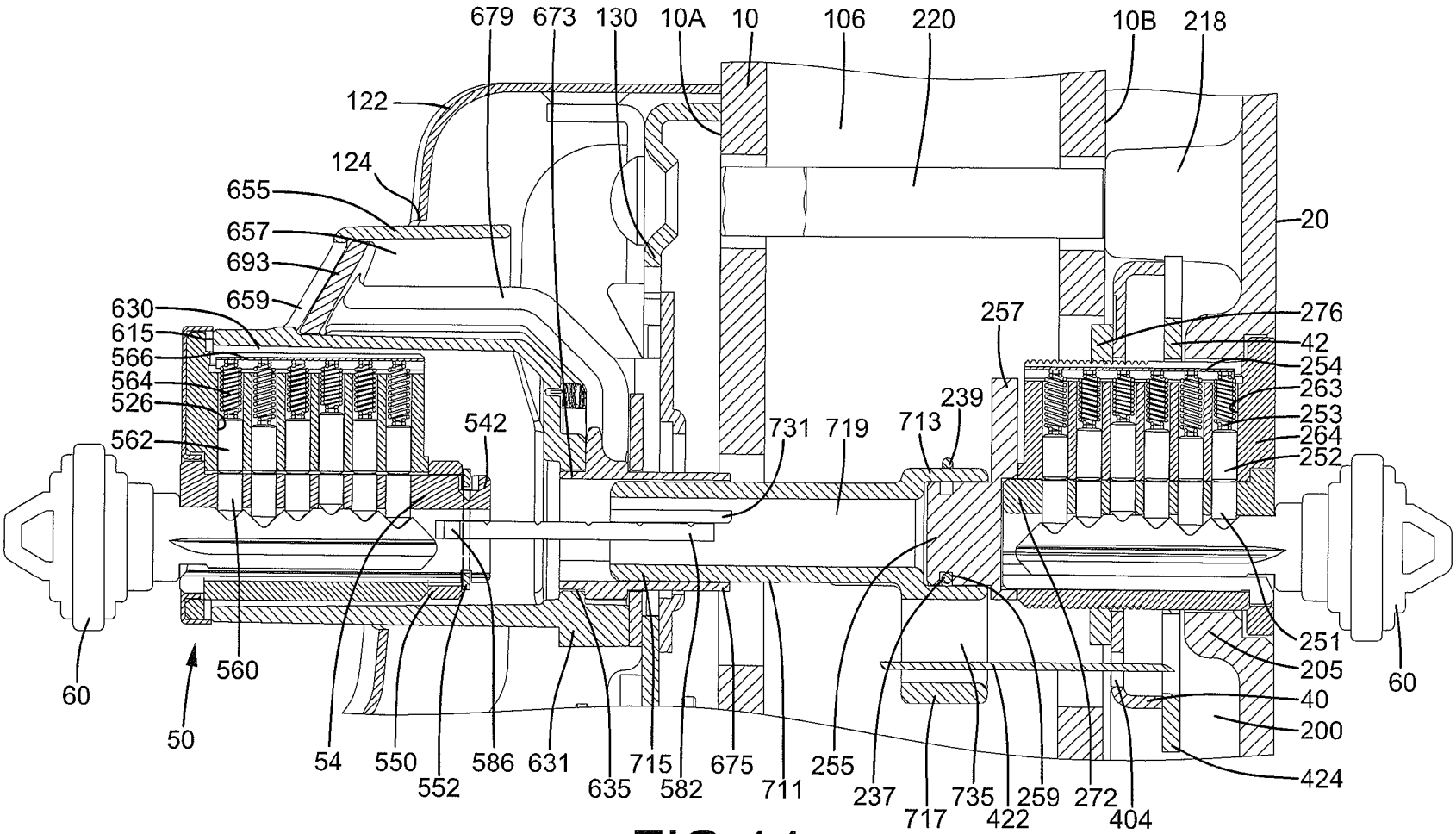
FIG. 14 is a view similar to FIG. 13, with keys inserted into the outer cylinder and an inner cylinder of the locking mechanism.
Figure 15:
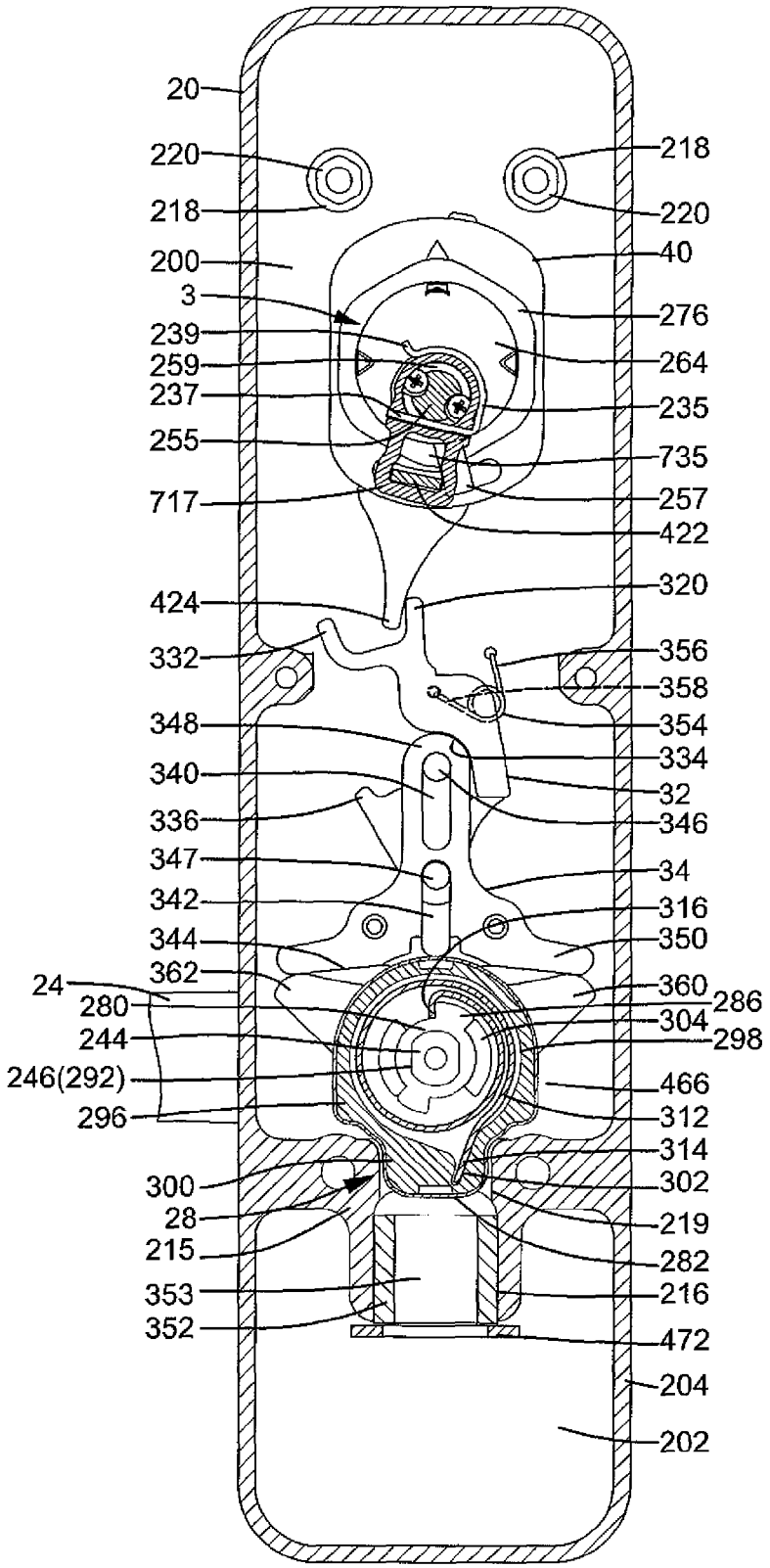
FIG. 15 is a view similar to FIG. 6, with a limiting member moved to a blocking position.
Figure 16:
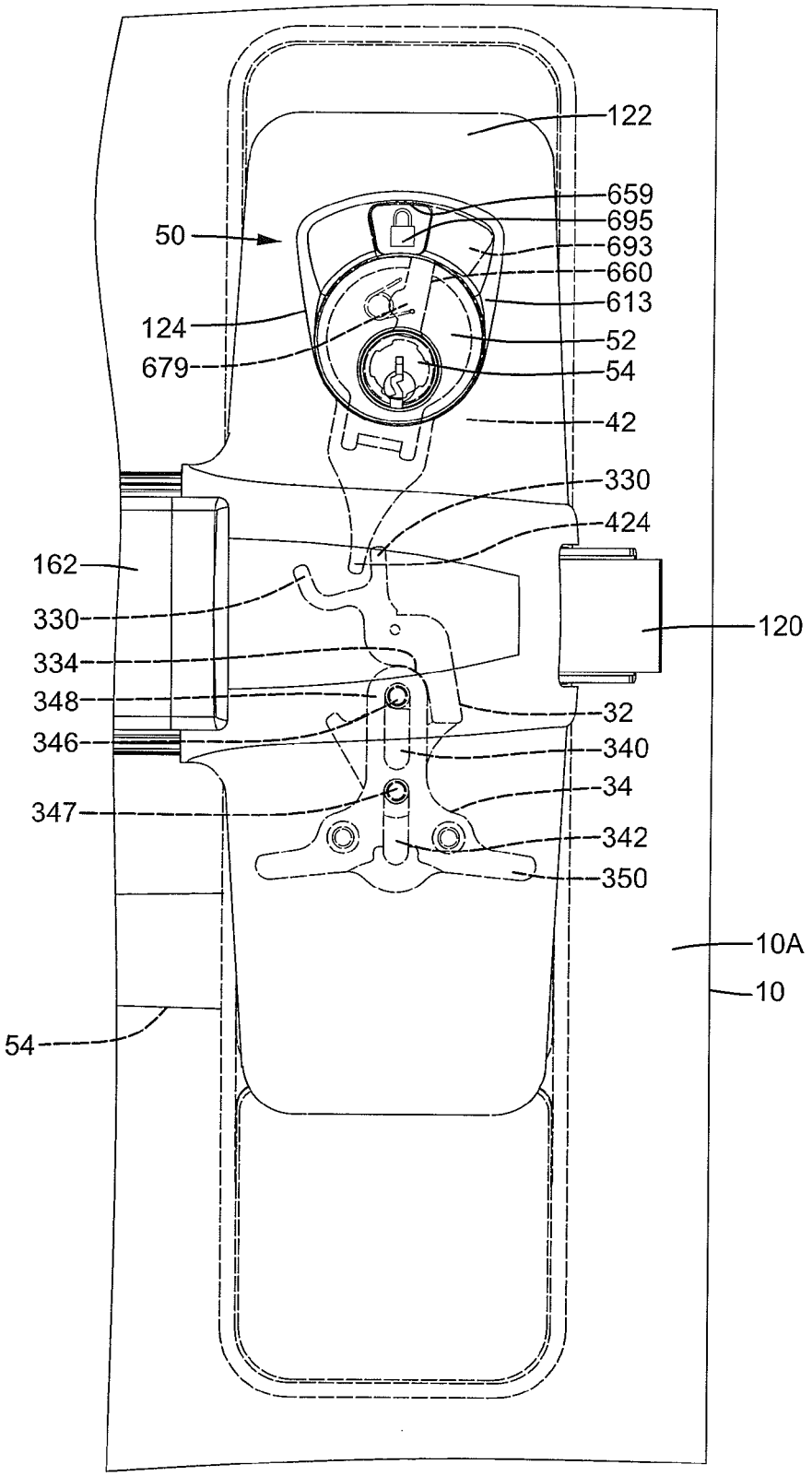
FIG. 16 is a side view of the panic exit door lock in a status shown in FIG. 15, allowing observation of an indicator through a window.

To set the locking function from outer side 10B of door, a key 60 (FIG. 14) is inserted into outer lock core 270 in outer cylinder 26 to unlock outer lock core 270 and to rotate outer lock core 270 and actuating block 255. Ear 257 of actuating block 255 is rotated to press against tab 422 of mover 42. Tab 422 of mover 42 pushes second protruded portion 332 of limiting member 32 so that stop 324 of limiting member 32 rotates toward first section 348 of sliding member 34 until stop 324 abuts on top of first section 348 of sliding member 34. At the same time, tab 422 of mover 42 presses against flange 717 of driving block 711, causing joint pivotal movement of driving block 711 and indicator member 660. Thus, indicator member 660 pivots to a position in which second portion 695 of indicator 691 is aligned with window 659 of inner cylinder seat 613 (FIG. 16). In this case, limiting member 32 is in a blocking position (FIG. 15). Furthermore, when limiting member 32 rotates, second tang 358 of spring 354 rotates about a pivot axis defined by first tang 356 to a position retaining limiting member 32 in the blocking position. Movement of sliding member 34 is blocked by limiting member 32 so that actuating member 36 and follower 38 can not rotate. Thus, handle 24 can not be rotated. In this state, unlatching can not be achieved through operation of handle 24. A locking function is, thus, provided. Furthermore, the user can see locking mechanism 3 is in the locking state through window 659 (FIG. 15) indicating that unlatching can not be achieved by operating handle 24 of outer operational device 2.

When it is desired to remove the locking setting from outer side 10B of door 10, key 60 is inserted into outer lock core 270. Outer lock core 270 and actuating block 255 are rotated when key 60 is rotated, so that ear 257 of actuating block 255 is rotated to press against tab 422 of mover 42 in a reverse direction. Tab 422 of mover 42 pushes first protruded portion 330 of limiting member 32 and flange 717 of driving block 711 so that limiting member 32, driving block 711, and indicator member 660 jointly pivot clockwise. At the same time, second tang 358 of spring 354 is pulled and rotates about the pivot axis defined by first tang 356, such that spring 354 returns to a position retaining limiting member 32 in the release position (FIG. 5). Furthermore, first portion 693 of indicator 691 of indicator member 660 is aligned with window 659 of inner cylinder seat 613. Movement of sliding member 34 is no longer blocked by limiting member 32 so that actuating member 36 and follower 38 can rotate. Thus, handle 24 can be rotated for unlatching purposes. Furthermore, the user can see locking mechanism 3 is in the unlocking state (FIG. 5A) allowing unlatching through operation of handle 24 of outer operational device 2.

To set the locking function from inner side 10A of door, key 60 is inserted into inner lock core 54 in inner cylinder 50 to unlock inner lock core 54. Inner lock core 54, tongue 58, driving block 711, and indicator member 660 pivot when key 60 is rotated. Flange 717 of driving block 711 is rotated to press against tab 422 of mover 42. Tab 422 of mover 42 pushes second protruded portion 332 of limiting member 32 so that stop 324 of limiting member 32 rotates toward first section 348 of sliding member 34 until stop 324 abuts on top of first section 348 of sliding member 34. Furthermore, indicator member 660 pivots to a position in which second portion 695 of indicator 691 is aligned with window 659 of inner cylinder seat 613. In this case, limiting member 32 is in the blocking position (FIG. 15). Furthermore, when limiting member 32 rotates, second tang 358 of spring 354 rotates about the pivot axis defined by first tang 356 to a position retaining limiting member 32 in the blocking position. Movement of sliding member 34 is blocked by limiting member 32 so that actuating member 36 and follower 38 can not rotate. Thus, handle 24 can not be rotated. In this state, unlatching can not be achieved through operation of handle 24. A locking function is, thus, provided. Furthermore, the user can see locking mechanism 3 is in the locking state through window 659 (FIG. 16) indicating that unlatching can not be achieved by operating handle 24 of outer operational device 2.

When it is desired to remove the locking setting from inner side 10A of door 10, key 60 is inserted into inner lock core 54 in inner cylinder 50 to pivot inner lock core 54, tongue 58, driving block 711, and indicator member 660. Flange 717 of driving block 711 is rotated to press against tab 422 of mover 42 in a reverse direction. Tab 422 of mover 42 pushes first protruded portion 330 of limiting member 32 so that limiting member 32 rotates clockwise. At the same time, second tang 358 of spring 354 is pulled and rotates about the pivot axis defined by first tang 356, such that spring 354 returns to a position retaining limiting member 32 in the release position (FIG. 5). Furthermore, indicator member 660 pivots to the position in which second portion 695 of indicator 691 is aligned with window 659 of inner cylinder seat 613. Movement of sliding member 34 is no longer blocked by limiting member 32 so that actuating member 36 and follower 38 can rotate. Thus, handle 24 can be rotated for unlatching purposes. Furthermore, the user can see locking mechanism 3 is in the unlocking state (FIG. 5A) allowing unlatching through operation of handle 24 of outer operational device 2.

When indicator member 660 pivots between two positions while switching locking mechanism 3 between the locking state and the unlocking state, the locking state or unlocking state of locking mechanism 3 can be viewed through window 659 of inner cylinder seat 613.

Now that the basic teachings of the present invention have been explained, many extensions and variations will be obvious to one having ordinary skill in the art. For example, locking mechanism 3 does not have to include resilient clip 235 and limiting plate 697. Furthermore, actuating block 255 does not have to include annular groove 259. Further, the inner periphery of engagement hole 677 of indicator member 660 can include a stepped portion such that the distal end of the connection portion 715 of the driving block 711 abuts against the stepped portion and such that the distal end of sleeve portion 713 of driving block 711 abuts against actuating block 255 when tongue 58 extends through engagement hole 677, preventing driving block 711 from moving along third axis Z.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A panic exit door lock comprising:

a base adapted to be mounted to an inner side of a door;

a sliding device slideably mounted to the base;

a latch operably coupled to the sliding device and moveable between an extended, latching position and a retracted, unlatching position;

a cover adapted to be mounted to an outer side of the door;

a sliding member slideably received in the cover and operably connected to the sliding device;

a handle pivotably mounted to the cover and operably connected to the sliding member such that pivotal movement of the handle causes sliding of the sliding member, moving the latch between the extended, latching position and the retracted, unlatching position;

a limiting member pivotably received in the cover between a blocking position not allowing movement of the sliding member and a release position allowing movement of the sliding member, with the handle being rotatable when the limiting member is in the release position, with the handle being not rotatable when the limiting member is in the blocking position;

an outer cylinder including an outer cylinder body mounted to the cover and an outer lock core rotatably received in the outer cylinder body;

an actuating block fixed to the outer lock core, with the actuating block and the outer lock core being jointly rotatable;

a driving member fixed to the sliding member, with the driving member and the sliding member being jointly moveable, with the driving member including a rod coupled to the sliding device;

a mover rotatably mounted around the cylinder and including a tab and an actuating bar, with the tab operably connected to the actuating block, with the actuating bar operably connected to the limiting member, with the mover being rotated to move the limiting member between the blocking position and the release position when the actuating block is rotated by rotating the outer lock core;

an inner cylinder seat fixed to the base, with the inner cylinder seat including a peripheral wall defining a first compartment, with a shield formed on the peripheral wall and defining a second compartment, with the shield further including a window in communication with the second compartment;

an inner cylinder received in the first compartment, with the inner cylinder including an inner cylinder body and an inner lock core rotatably received in the inner cylinder body;

a driving block pivotably connected to the actuating block, with the driving block including a connection portion and a sleeve portion, with the sleeve portion mounted around the actuating block, with the driving block further including a coupling hole in an end of the connection portion, with a flange formed on an outer periphery of the sleeve portion and operably connected to the tab of the mover;

an indicator member including a first section pivotably connected to the inner cylinder seat, with the indicator member further including a second section fixed to the connection portion of the driving block, with the indicator member and the driving block being jointly moveable, with an arm extending from the indicator member, with an indicator provided on the arm and having a first portion indicating the limiting member is in the release position and a second portion indicating the limiting member is in the blocking position, with one of the first and second portions selectively aligned with the window; and a tongue including front and rear ends spaced from each other along a first axis, with the rear end of the tongue fixed to the inner lock core, with the front end of the tongue coupled in the coupling hole of the driving block, with the inner lock core, the tongue, and the driving block being jointly rotatable, wherein when the inner lock core is rotated, the driving block and the mover are rotated to move the limiting member between the blocking position and the release position, wherein when the outer lock core is rotated, the actuating block is rotated to push the mover to move the limiting member between the blocking position and the release position, and the mover actuates the driving block and the indicator member to pivot jointly, wherein when the limiting member is in the release position, the first portion is aligned with the window of the inner cylinder seat, and wherein when the limiting member is in the blocking position, the second portion is aligned with the window of the inner cylinder seat.

2. The panic exit door lock as claimed in claim 1, with the inner lock cylinder further including a first end face and a second end face spaced from the first end face, with the first compartment extending from the first end face through the second end face, with the inner cylinder seat further including a pivotal portion extending from the second end face, with the pivotal portion including a pivotal hole extending from the third end face to the first compartment along the first axis, with the pivotal portion further including a notch, with the first section of the indicator member pivotably received in the pivotal hole of the inner cylinder seat, and with the arm extending through the notch into the second compartment.

3. The panic exit door lock as claimed in claim 1, with two inner protrusions formed on an inner periphery of the coupling hole and spaced from each other in a diametric direction, with pivotal movement of the tongue pressing against the two inner protrusions to pivot the driving block and the indicator member.

* * * * *